US006332764B1

(12) United States Patent
Kohsokabe et al.

(10) Patent No.: US 6,332,764 B1
(45) Date of Patent: Dec. 25, 2001

(54) DISPLACEMENT TYPE FLUID MACHINE HAVING AN ORBITING DISPLACER FORMING A PLURALITY OF SPACES AND METHOD FOR MANUFACTURING SAME

(75) Inventors: Hirokatsu Kohsokabe, Ibaraki-ken; Masahiro Takebayashi, Tsuchiura; Hiroaki Hata; Koichi Inaba, both of Tochigi-ken; Isao Hayase, Tsuchiura; Kenji Tojo, Ibaraki-ken, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/592,669

(22) Filed: Jun. 13, 2000

Related U.S. Application Data

(62) Division of application No. 09/266,860, filed on Mar. 12, 1999, now Pat. No. 6,164,941, which is a continuation of application No. 08/791,959, filed on Jan. 31, 1997, now abandoned.

(30) Foreign Application Priority Data

Jan. 31, 1996 (JP) ..... 8-014995

(51) Int. Cl.[7] ..... F01C 1/04
(52) U.S. Cl. ..... 418/61.1; 418/77
(58) Field of Search ..... 418/61.1, 77; 29/888.02

(56) References Cited

U.S. PATENT DOCUMENTS 1,277,437 * 9/1918 Lind ..... 418/61.1

FOREIGN PATENT DOCUMENTS

589419 * 3/1934 (DE) ..... 418/61.1

* cited by examiner

*Primary Examiner*—John J. Vrablik
(74) *Attorney, Agent, or Firm*—Antonelli, Terry, Stout & Kraus, LLP

(57) ABSTRACT

A displacement type fluid machine for reducing a fluid loss of a discharge process as much as that of a scroll fluid machine has a displacer which is provided with at least one through hole for working the outer wall surface of said displacer during manufacture of said displacer, said at least one through hole extending in an axial direction of a rotating shaft.

1 Claim, 24 Drawing Sheets

DISPLACEMENT TYPE FLUID MACHINE HAVING AN ORBITING DISPLACER FORMING A PLURALITY OF SPACES AND METHOD FOR MANUFACTURING SAME

This is a divisional application of U.S. Ser. No. 09/266,860, filed Mar. 12, 1999, U.S. Pat. No. 6,164,941, which is a continuation of U.S. Ser. No. 08/791,959, filed Jan. 31, 1997 (now abandoned).

TECHNICAL FIELD

The present invention relates to, for example, a pump, a compressor, an expander, etc., more specifically to a displacement type fluid machine.

BACKGROUND ART

As a conventional displacement type fluid machine, a reciprocating fluid machine for moving a working fluid by repeating a reciprocation of a piston in a cylindrical cylinder, a rotary (rolling piston type) fluid machine for moving the working fluid by eccentrically rotating a cylindrical piston in the cylindrical cylinder, a scroll fluid machine for moving the working fluid by engaging fixed scroll with an orbiting scroll having spiral wraps standing up on end plates and by gyrating the orbiting scroll are well known.

Since the reciprocating fluid machine is simply constructed, it is possible to prepare the machine easily and to be inexpensive. On the other hand, since a process from a suction completion to a discharge completion is short of shaft angle of 180° so that a flow velocity of the process for the discharge gets faster, there is a problem that a pressure loss is increased so that a performance is reduced. Further, since it is necessary to reciprocate the piston, so that a rotary shaft system can not be completely balanced, there is another problem that a vibration and a noise is larger.

Also, in the case of the rotary fluid machine, since the process from the suction completion to the pressure completion has the shaft angle of 360°, there is less problem that the pressure loss during the discharge process is increased compared to the reciprocating fluid machine. However, since the working fluid is discharged once per one rotation of the shaft, a variation of a gas compression torque is relatively higher, accordingly, there is the same problem of the vibration and noise as the reciprocating fluid machine.

Further, in the case of the scroll fluid machine, since the process from the suction completion to the discharge completion has the long shaft angle of 360° or more (the scroll fluid machine practically used as an air conditioner has usually 900°), so that the pressure loss during the process of the discharge is low, a plurality of working chambers are formed generally, so that there is an advantage that the variation of the gas compression torque is low and the vibration and noise is less. When the wraps are engaged, it is necessary to manage a clearance between the spiral wraps and the clearance between the end plate and a wrap tip. Thus, the fluid machine must be worked with high accuracy, so that there is further problem that the expense of working is expensive. Further, since the process from the suction completion to the discharge completion has the long shaft angle of 360° or more, it takes a long time for the compression process, so that there is further problem that an internal leakage is increased.

By the way, known is a displacement type fluid machine in which a displacer (a rotary piston) for moving the working fluid is not rotated relative to the cylinder in which the working fluid is suctioned, but is gyrated with an almost constant radius, that is, is gyrated to transmit the working fluid. This kind of displacement type fluid machines have been proposed in Japanese Patent Unexamined Publication No. 55-23353 (Document 1), U.S. Pat. No. 2,112,890 (Document 2), Japanese Patent Unexamined Publication No. 5-202869 (Document 3) and Japanese Patent Unexamined Publication No. 6-280758 (Document 4). These displacement type fluid machines comprise a petal-shaped piston having a plurality of members (vanes) radially extended from a center and a cylinder having a hollow portion having an almost the same shape as this piston, wherein this piston is gyrated in this cylinder in order to move the working fluid.

DISCLOSURE OF THE INVENTION

Since the displacement type fluid machines according to the Documents 1 to 4 do not have a portion for reciprocation of the reciprocating fluid machine, it is possible to balance the rotary shaft system completely. Thus, since the vibration is low, further a sliding velocity between the piston and the cylinder is low, the displacement type fluid machines are essentially provided with the advantageous characteristic that it is possible to reduce a friction loss.

However, the process from the suction completion to the discharge completion in each working chamber formed by the plurality of vanes constituting a piston and the cylinder has the short shaft angle θc of about 180° (210°) (about a half of that of the rotary fluid machine), the flow velocity during the discharge process gets faster, there is further problem that the pressure loss is increased, so that the performance is reduced. Also, in the fluid machines described in these Documents, the shaft angle from the suction completion to the discharge completion in each working chamber is short and a time lag is occurred from the suction completion to the next (compression) process (the suction completion) start and the working chamber from the suction completion to the discharge completion is one-sided around a drive shaft to be formed. Therefore, the fluid machines are not dynamically balanced and a rotating moment for prompting the piston itself to be rotated is excessively applied to the piston as a reaction from the compressed working fluid, thereby there is further problem of a reliability that the friction and abrasion of the vanes are occurred.

It is a first object of the present invention to provide a fluid machine which can reduce the fluid loss during the discharge process to the same extent of the scroll fluid machine and further can be more easily prepared than the scroll fluid machine.

It is a second object of the present invention to provide a more reliable displacement type fluid machine which can reduce the rotating moment to be applied to the rotary piston and solve the problem of the friction and abrasion.

It is a third object of the present invention to provide means for preparing the rotary piston inexpensively.

The first object is achieved by providing a displacement type fluid machine in which a displacer and a cylinder are located between end plates, one space is formed by an inner wall surface of said cylinder and an outer wall surface of said displacer when a center of said displacer is located on a center of rotation of a rotating shaft, and a plurality of spaces are formed when a positional relationship between said displacer and said cylinder is located on a center of gyration, wherein the curves of the inner wall surface of said cylinder and the outer wall surface of said displacer are formed so that a shaft angle θc of the process from the suction completion to the discharge completion in said plurality of spaces satisfies the following algorithm: $(((N-1)/N\cdot 360°)<\theta c\leqq 360°$, where, N is the number of the extrusions extruded inwardly of said cylinder.

The second object is achieved by providing a displacement type fluid machine in which a displacer and a cylinder are located between end plates, one space is formed by an inner wall surface of said cylinder and an outer wall surface of said displacer when a center of said displacer is located on a center of rotation of a rotating shaft, and a plurality of spaces are formed when a positional relationship between said displacer and said cylinder is located on a center of gyration, wherein the curves of the inner wall surface of said cylinder and the outer wall surface of said displacer are formed so that a maximum value of the number of spaces in processes from a suction completion to a discharge completion in said plurality of spaces becomes more than the number of extrusions extruded inwardly of said cylinder.

The third object is achieved by providing a displacement type fluid machine comprising a cylinder having an inner wall whose section shape comprises a continuous curve, a displacer having an outer wall faced to the inner wall of said cylinder and forming a plurality of spaces by said inner wall and the outer wall of said displacer when the displacer is gyrated, and a drive shaft for driving said displacer, wherein the hole passing through the surfaces different from the outer wall of said displacer is bored aside from a hole for inserting said drive shaft.

BEST MODE FOR CARRYING OUT THE INVENTION

Figure 1A:
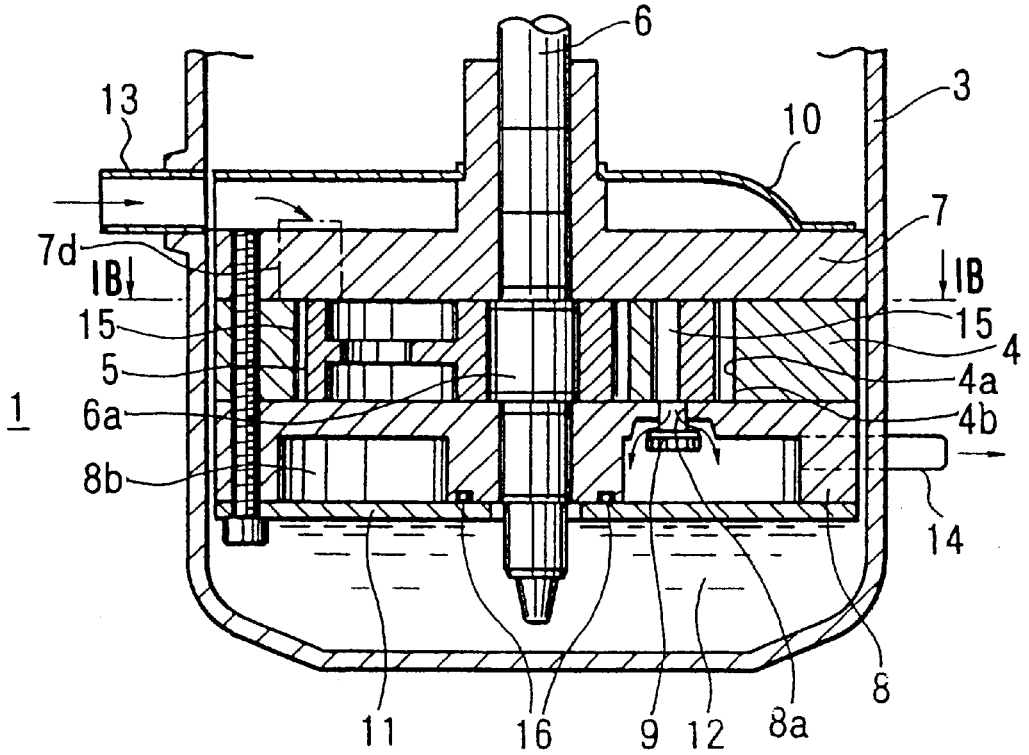
FIGS. 1A and 1B are a vertical sectional view and a plan view of a compression element of a sealed type compressor in case that the rotary type fluid machine according to the present invention is applied to the compressor, respectively.
Figure 1B:
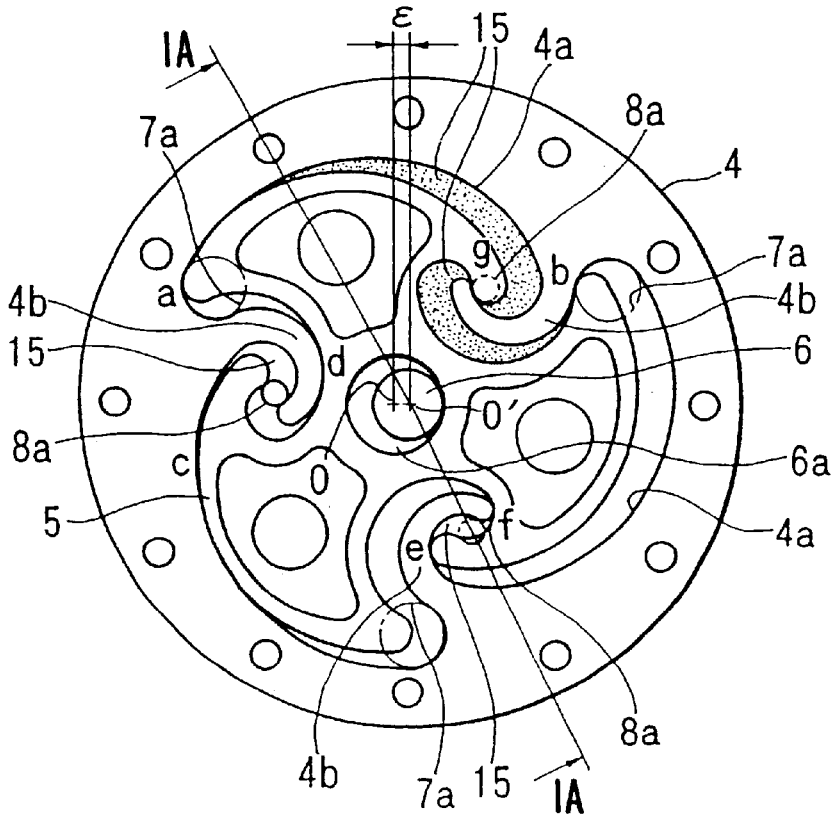
Figure 2:
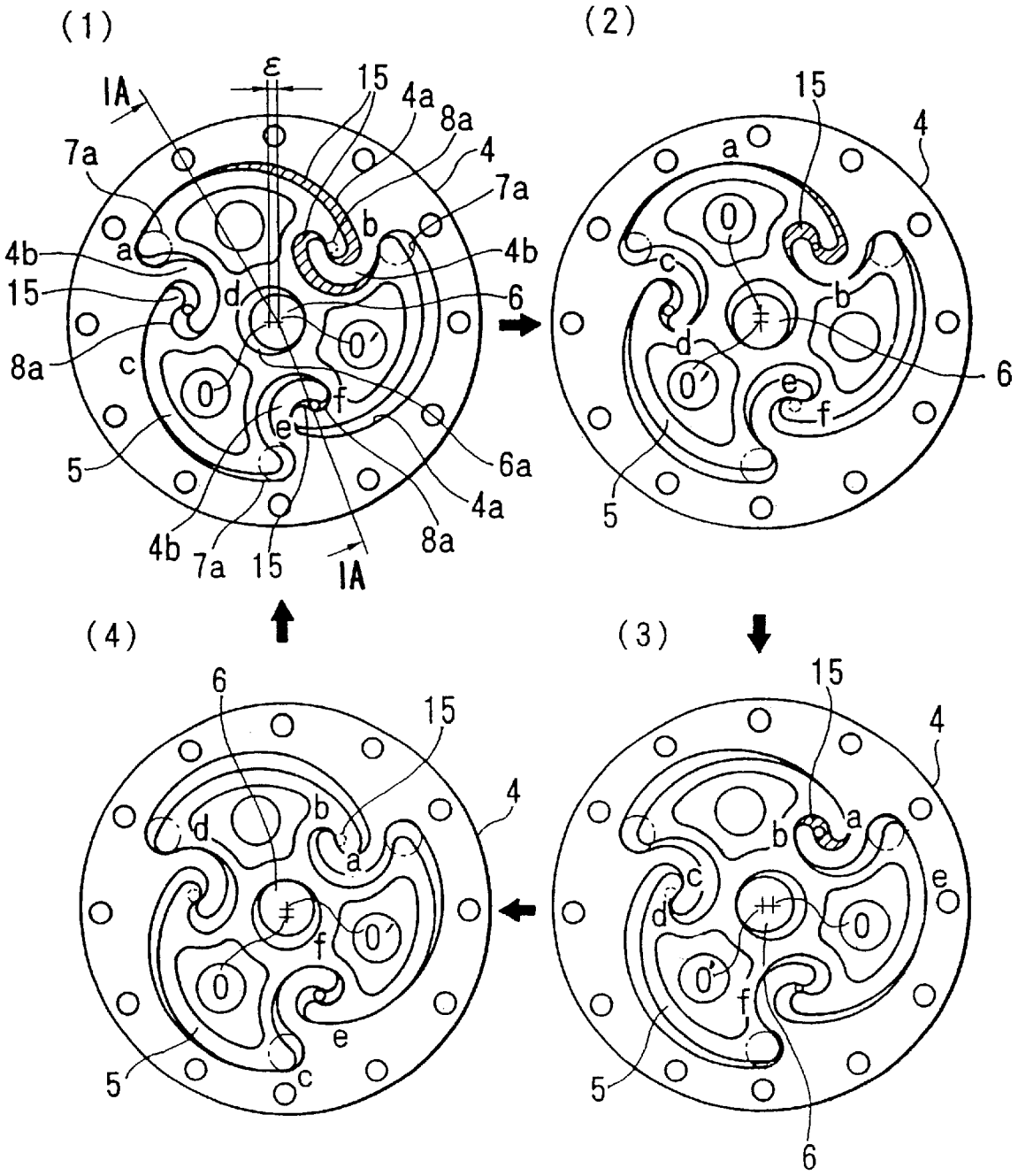
FIG. 2 is a view for explaining principle of the work of the rotary type fluid machine according to the present invention.
Figure 3:
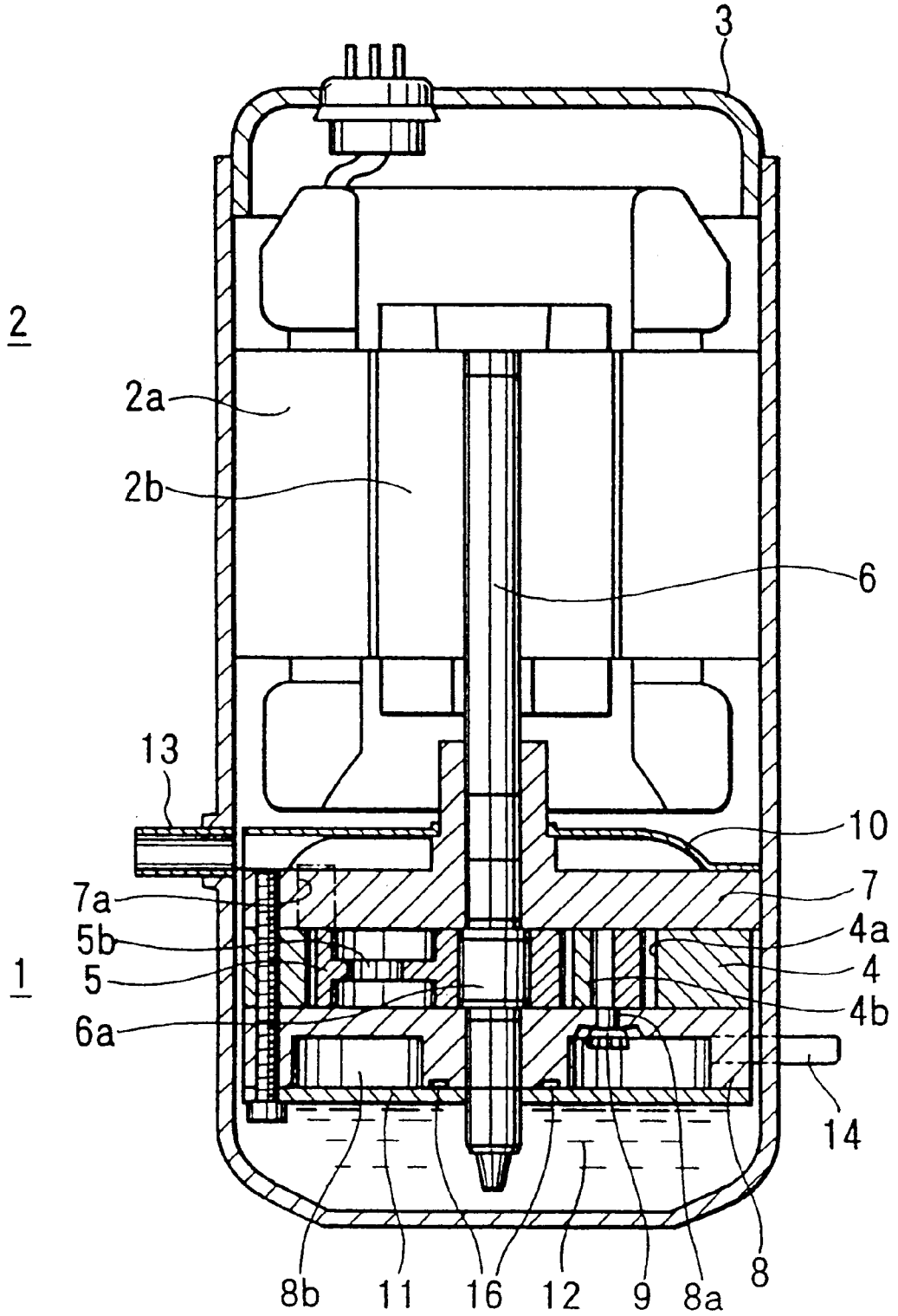
FIG. 3 is a longitudinal sectional view of the rotary type fluid machine according to the present invention.

The above described features of the present invention will be understood more clearly in reference with the following embodiments. An embodiment of the present invention will be explained below in reference with the accompanying drawings. First, FIGS. 1–3 are used in order to explain the construction of the rotary type fluid machine of the present invention. FIG. 1A is a vertical sectional view of a sealed type compressor in case that a displacement type fluid machine according to the present invention is used as a compressor (a sectional view taken along line A—A of FIG. 1B). FIG. 1B is a cross-sectional view taken along line B—B of FIG. 1A. FIG. 2 shows the principle of the work of the displacement type compression element. FIG. 3 is a vertical sectional view of the sealed type compressor in case of the displacement type fluid machine according to the present invention used as the compressor.

In FIG. 1, a displacement type compression element 1 according to the present invention and a motor element 2 (not shown) for driving the displacement type compression element 1 are accommodated in a sealed container 3. The displacement type compression element 1 will be explained in detail. A three-threaded wrap comprising a combination of three sets of same contour shapes is shown in FIG. 1B. A shape of an inner periphery of a cylinder 4 is formed so that each hollows whose shape is a leaf of a ginkgo appears for every 120° (a center is o') in the same shape. An end portion of each ginkgo leaf-shaped hollow has a plurality of generally arc-shaped vanes 4*b* (in this case, three vanes because of the three-threaded wrap) extruded inward. A rotary piston 5 is located within the cylinder 4 and is constructed so that it engages with an inner peripheral wall 4*a* (a portion having more curvature than the vane 4*b*) of the cylinder 4 and the vane 4*b*. When the center o' of the cylinder 4 corresponds to the center o of the rotary piston 5, a distance having a constant width is formed between both of contour shapes as a basic shape.

Next, the principle of working the displacement type compression element 1 will be explained in reference with FIGS. 1 and 2. A reference o denotes the center of the rotary piston 5, that is, the displacer. A reference o' denotes the center of the cylinder 4 (or a drive shaft 6). References a, b, c, d, e, and f denote engaging points where the inner peripheral wall 4*a* of the cylinder 4 and the vane 4*b* are engaged with the rotary piston 5. The same combinations of curves are smoothly connected at three points so that the shape of the inner peripheral contour is formed. Viewing one combination, a curve forming the inner peripheral wall 4*a* and the vane 4*b* is considered as one vortex curve having a thickness (the vortex starts from the end of the vane 4*b*). The inner wall curve (g-a) is a vortex curve whose wrap angle is substantially 360° (although the inner wall curve is designed so that the wrap angle is 360°, since the angle of 360° is not precisely set due to a preparing error, the expression "substantially 360°" is used. Accordingly, the expression "substantially 360°" will be similarly used below. The wrap angle will be described below in detail.). The outer curve (g-b) is a vortex curve having the wrap angle of substantially 360°. The inner peripheral contour of one combination is shaped by the inner wall curve and the outer wall curve. Spiral bodies are arranged on a circle at substantially equal pitch (in this case, the pitch is 120° because of the three-threaded wrap) and are adjacent to each other. The outer wall curve of a spiral body is connected to the inner wall curve of adjacent spiral body by a smooth connection curve (b–b') such as arc etc. so that the inner peripheral contour of the cylinder 4 is shaped. The outer peripheral contour of the rotary piston 5 is also shaped by the principle similarly to the cylinder 4.

As described above, the spiral bodies comprising three curves are arranged on the periphery at substantially equal pitch (120°). The object of the equal pitch is to allow to equally disperse load accompanied with a compression operation described below and further to easily prepare. Accordingly, if it is not especially essential to disperse the equal load and to easily prepare, an unequal pitch may be set.

An compression operation by using the cylinder 4 and the rotary piston 5 as constructed above will be explained in reference with FIG. 2. A numeral 7*a* denotes a suction port and a numeral 8*a* denotes a discharge port, each arranged at three positions. The drive shaft 6 is rotated so that the rotary piston 5 is not rotated around the center o' of the fixed cylinder 4, but is orbited by a rotary radius δ (=oo'). A plurality of working chambers 15 are formed around the center o' of the rotary piston 5 (in this embodiment, three working chambers are always formed). Here, the working chamber is the space of which suction is completed and compression (discharge) is started among a plurality of spaces surrounded and sealed by the inner peripheral contour (inner wall) of the cylinder and the outer peripheral contour (side wall) of the piston, that is, the space of which operation condition is in a period from the suction completion till discharge completion. In case that the above wrap angle is 360°, this space does not exist at the compression completion but the suction is also completed, and therefore, this space is counted and defined as one space. In case of using the machine as the pump, the working chamber is the space communicated with an outward portion via the discharge port. An explanation will be given in reference with one working chamber surrounded by the engaging points a and b and hatched (although this working chamber is divided into two parts at the suction completion, two parts of working chamber are immediately communicated with each other at the compression process start). FIG. 2(1) shows a state that the working gas suction from the suction port 7*a* to this working chamber is completed. FIG. 2(2) shows a state that the drive shaft 6 is rotated in 90° from the state shown in FIG. 2(1). FIG. 2(3) shows a state that the drive shaft 6 is further rotated in 180° from the state shown in FIG. 2(1). FIG. 2(4) shows a state that the drive shaft 6 is further rotated in 270° from the state shown in FIG. 2(1). When the drive shaft 6 shown in FIG. 2(4) is further rotated in 90°, the drive shaft 6 returns back to the state shown in FIG. 2(1). Thus, as the drive shaft 6 is rotated, the volume of the working chamber 15 is reduced. Since the discharge port 8*a* is closed by a discharge valve 9 (shown in FIG. 1), the working fluid is compressed. When the pressure in the working chamber 15 becomes higher than an outer discharge pressure, the discharge valve 9 is automatically opened by a pressure difference, so that the compressed working gas is discharged through the discharge port 8*a*. The shaft angle from the suction completion (the compression start) to the discharge completion is 360°. Next suction process is prepared during each compression and discharge process is being carried out. Next compression process is started at the suction completion. For example, taking the example of the space formed by the engaging points a and b, at the step shown in FIG. 2(1) the suction is already started from the suction port 7*a*. As the rotation is further carried out, the volume of the space is increased. When the process proceeds to the state shown in FIG. 2(4), this space is divided. The fluid corresponding to the divided amount is compensated by the space formed by the engaging points b and e.

A detailed explanation will be described below. Taking the example of the working chamber formed by the engaging points a and b in the state shown in FIG. 2(1), the suction has been started in the space formed by the adjacent engaging points a and d. After the shaft angle is changed to 360°, the fluid in the space must be compressed by the space formed by the engaging points a and b. However, this space is once expanded as shown in FIG. 2(3), and thereafter this space is divided in the state shown in FIG. 2(4). Accordingly, all the fluid in the space formed by the engaging points a and d is not compressed by the space formed by the engaging points a and b. The fluid as much as the fluid volume which is separated and not taken in the space formed by the engaging points a and d is applied by the fluid flowing into a space formed by the engaging points e and b in the vicinity of the discharge port after a space formed by the engaging points b and e and in suction process in FIG. 2(4) is divided as shown in FIG. 2(1). As described above, the wrap bodies are arranged at the equal pitch so that this operation is carried out. That is, since the piston and the cylinder are shaped by a repetition of the same contour shape, it is possible to compress substantially the same volume of fluid even if any working chamber is provided with the fluid from different spaces. Even in case of the unequal pitch, it is possible to work so that the volume formed in each space can be equal, but productivity becomes wrong. According to any prior arts as described above, the space during the suction process is closed, is compressed and discharged. On the other hand, according to one aspect of the embodiment of the present invention, the space in the suction process adjacent to the working chamber is divided and performs compression. This is one of the features of the invention.

As explained above, the working chambers for continuously compressing are dispersed and arranged around a drive bearing 5*a* located at the center of the rotary piston 5 at substantially equal pitch and the working chambers perform compressions with different phases. That is, in one space, the shaft angle from the suction to the discharge is 360°, but in case of the embodiment, three working chambers are formed and discharge with shifted phase of 120°. Accordingly, the compressor discharges a coolant three times during the shaft rotating in the shaft angle of 360°. Thus, it is possible to reduce a discharge pulsation of the coolant, which can not be carried out by the reciprocating type, the rotary type and the scroll type fluid machines.

Consider the space in the instant of the compression completion (the space surrounded by the engaging points a and b) as one space. In case of the wrap angle of 360° such as the embodiment, whenever the compressor is operated, it is designed so that the space for the suction process and the space for the compression process are alternately located. Thus, it is possible to proceed to next compression process immediately in the instant of the compression process and to compress the fluid smoothly and continuously.

Next, the compressor incorporating the rotary type compression element 1 having the shape as described above will be explained in reference with FIGS. 1 and 3. As shown in FIG. 3, the rotary type compression element 1 has the cylinder 4 and the piston 5 as described in detail above, further, a drive shaft 6 for driving the rotary piston 5 with a crank portion 6*a* engaging with the bearing at the center of the rotary piston 5, a main bearing 7 and an auxiliary bearing 8 performing end plates for closing opening portions at both ends of the cylinder 4 and bearing for supporting the drive shaft 6, a suction port 7*a* formed on the end plate of the main bearing 7, a discharge port 8*a* formed on the end plate of the auxiliary bearing 8, and a discharge valve 9 of a reed valve type (opened and closed by a differential pressure) for opening and closing the discharge port 8*a*. Also, a numeral 5*b* denotes a through hole bored through the rotary piston 5. A numeral 10 denotes a suction cover mounted to the main bearing 7. A numeral 11 denotes a discharge cover for forming a discharge chamber 8*b* integrated with the auxiliary bearing.

A motor element 2 comprises a stator 2*a* and a rotor 2*b*. The rotor 2*b* is, for example, fixed to one end of the drive shaft 6 by shrinkage fit. In order to enhance a motor efficiency, the motor element 2 comprises a brushless motor whose drive is controlled by a three-phase inverter. Other motor type, for example, a DC motor and an induction motor may be applied.

A numeral 12 denotes a lubricating oil stored at a bottom portion of the sealed container 3. A lower end portion of the drive shaft 6 is soaked into the lubricating oil. A numeral 13 denotes a suction pipe. A numeral 14 denotes a discharge pipe. A numeral 15 denotes the above-described working chambers formed by engagement of the inner peripheral wall 4*a* and vanes 4*b* with the rotary piston 5. Also, the discharge chamber is separated from the pressure in the sealed container 3 by a sealing member 16 such as an O ring.

A flow of the working gas (coolant) will be described with reference to FIG. 1. As shown by an arrow in FIG. 1, the working gas passes through the suction pipe 13, enters into the suction cover 10 mounted to the main bearing 7, and enters into the rotary type compression element 1 through the suction port 7*a*, where the drive shaft 6 is rotated for gyrating the rotary piston 5 so that the volume in the working chamber is reduced to compress the working gas. The compressed working gas passes through the discharge port 8*a* formed on the end plate of the auxiliary bearing 8, pushes up the discharge valve 9, enters into the discharge chamber 8*b*, passes through the discharge pipe 14, and flows outwardly. The distance is formed between the suction pipe 13 and the suction cover 10 to allow the working gas pass through into the motor element 2 to cool the motor element.

Figure 4A:
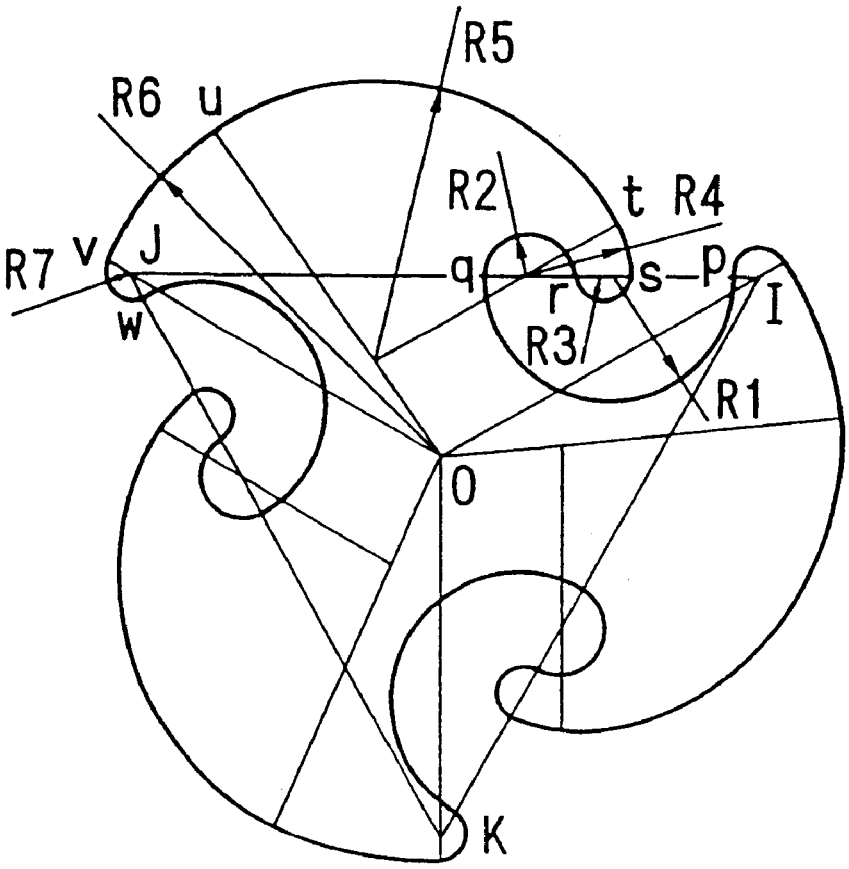
FIGS. 4A and 4B are views showing a construction of contours of the rotary piston of the rotary type fluid machine according to the present invention.
Figure 4B:
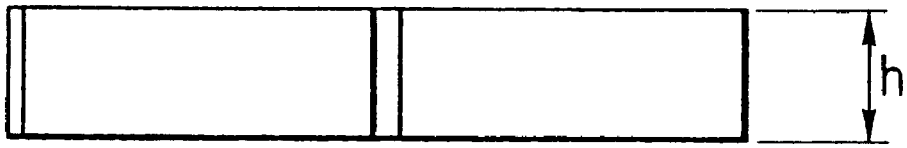
Figure 5A:
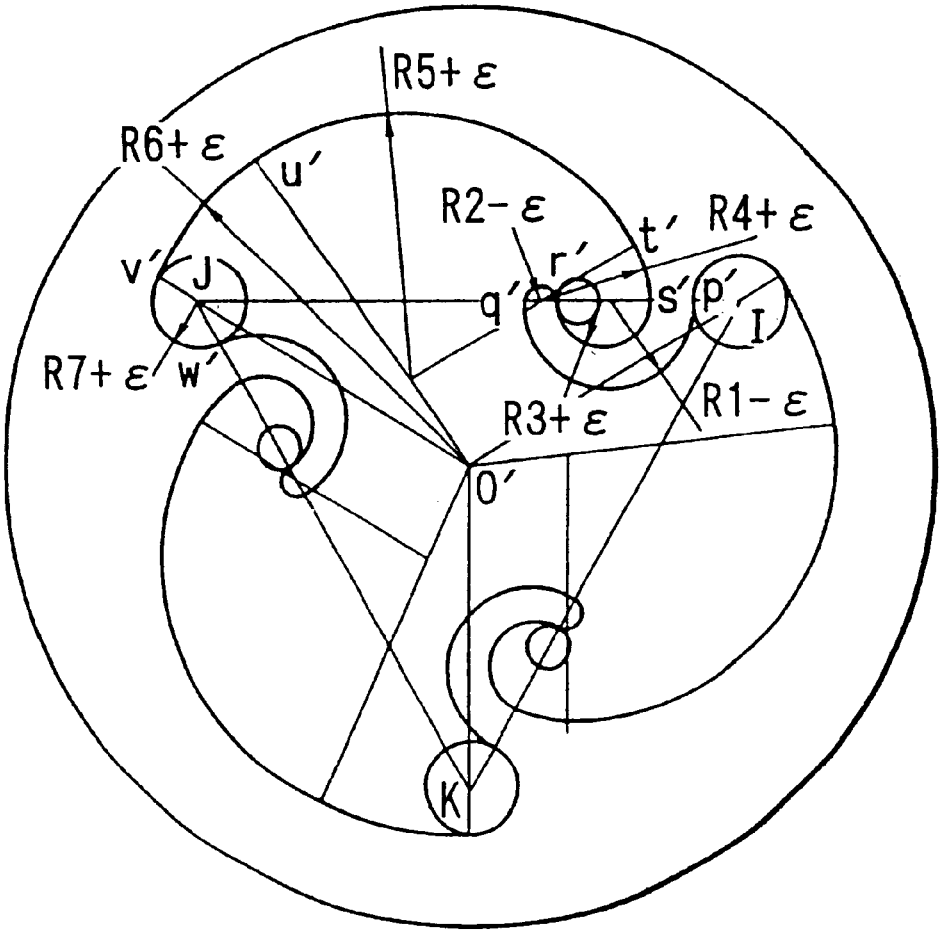
FIGS. 5A and 5B are views showing construction of contours of the cylinder of the rotary type fluid machine according to the present invention.
Figure 5B:
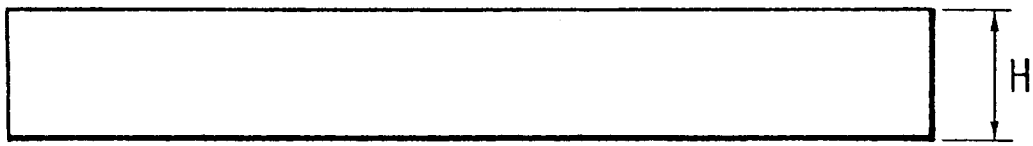
Figure 6:
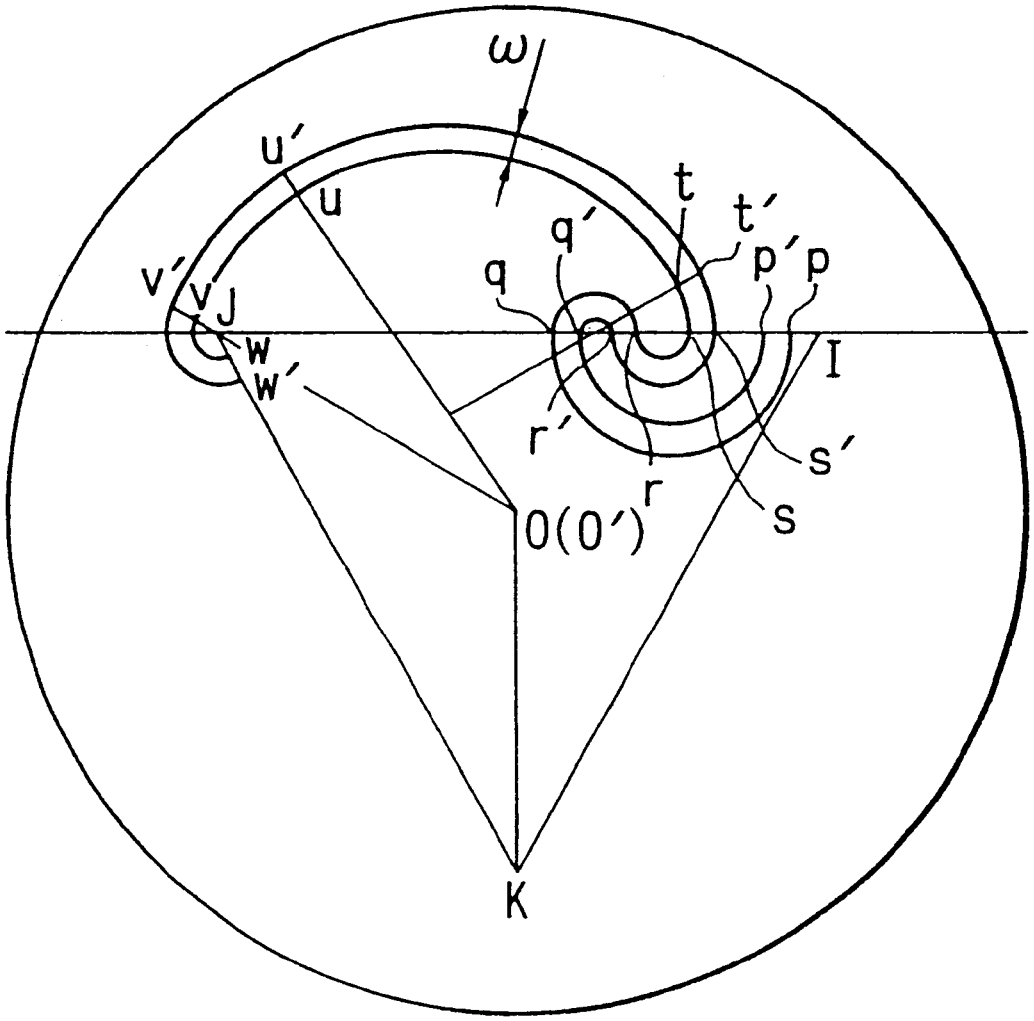
FIG. 6 is a view of the rotary piston shown in FIGS. 4A and 4B overlaying the cylinder shown in FIGS. 5A and 5B.

A method for forming the contour shape of the piston 5 and cylinder 4 which are, main components of the rotary type compression element 1 of the present invention will now be explained in reference with FIGS. 4–6 (taking the example of using the three-threaded wrap). FIGS. 4A and 4B show an example shape of the rotary piston whose plan shape comprises a combination of arcs, FIG. 4A shows a plan view, and FIG. 4B shows a cross-sectional view. FIGS. 5A and 5B show an example cylinder shape paired and engaged with the rotary piston shown in FIGS. 4A and 4B. FIG. 6 shows the center o of the rotary piston shown in FIGS. 4A and 4B overlaying the center o' of the cylinder shown in FIGS. 5A and 5B (a set of portion).

In FIG. 4A, the rotary piston is shaped so that three same contours are connected around the center o (the centroid of an equilateral triangle IJK). The contour shape is formed by seven arcs from a radius R1 to a radius R7, where points p, q, r, s, t, u, v and w are the contact points of each arcs having different radius, respectively. A curve pq is a half circle having the radius R1 whose center is laid on a side IJ of the equilateral triangle, where the point p is located at distance of the radius R7 from an apex I. A curve qr is the arc of the half circle having the radius R2 whose center is laid on the side IJ. A curve rs is the arc of the half circle having the radius R3 whose center is laid on the side IJ. A curve st is the arc of the half circle having the radius R4 (=2·R3+R2) whose center is laid on the side IJ, similarly. A curve tu is the arc of the half circle having the radius R5 whose center is laid on an extended line connecting the contact point t with the center of the radius R2. A curve uv is the arc having the radius R6 whose center is the centroid o. A curve vw is the arc having the radius R7 whose center is an apex J. The angles of arcs having the radii R4, R5, R6 are determined by the condition that the arcs are smoothly connected to one another at the contact points (each inclination angle of each tangent line is same at the contact point). When the contour shape from the point p to the point w is rotated around the centroid o counterclockwise in 120°, the point w is matched to the point p. The contour shape is further rotated in 120°, the contour shape of total periphery is completed. Thereby, the plan shape of the rotary piston (a thickness h) is obtained.

When the plan shape of the rotary piston is determined, this rotary piston is gyrated with the gyrating radius $\epsilon$ so that the contour shape of the cylinder for engaging with the rotary piston becomes an off-set curve having an outward normal distance $\epsilon$ of a curve forming the contour shape of the rotary piston as shown in FIG. 6.

A contour shape of the cylinder will be explained in reference with FIG. 5. A triangle IJK is the same as the triangle shown in FIG. 4. The contour shape is formed by seven arcs similarly to the rotary piston. Points p', q', r', s', t', u', v' and w' are the contact points of each arc having different radius, respectively. A curve p'q' is a half circle having the radius (R1−$\epsilon$) whose center is laid on the side IJ of the equilateral triangle, where the point p' is located at distance of the radius (R7+$\epsilon$) from the apex I. A curve q'r' is the arc of the half circle having the radius (R2−$\epsilon$) whose center is laid on the side IJ. A curve r's' is the arc of the half circle having the radius (R3+$\epsilon$) whose center is laid on the side IJ. A curve s't' is the arc of the half circle having the radius (R4+ϵ) whose center is laid on the side IJ, similarly. A curve t'u' is the arc of the half circle having the radius (R5+ϵ) whose center is laid on an extended line connecting the contact point t' with the center of the radius (R2−ϵ). A curve u'v' is the arc having the radius (R6+ϵ) whose center is the centroid o'. A curve v'w' is the arc having the radius (R7+ϵ) whose center is the apex J. The angles of arcs having the radii (R4+ϵ), (R5+ϵ), (R6+ϵ) are determined by the condition that the arcs are smoothly connected to one another at the contact points (each inclination angle of each tangent line is same at the contact point). When the contour shape from the point p' to the point w' is rotated around the centroid o' counterclockwise in 120°, the point w' is matched to the point p'. The contour shape is further rotated in 120°, the contour shape of total periphery is completed. Thereby, the plan shape of the cylinder is obtained. The thickness H of the cylinder is slightly thicker than the thickness h of the rotary piston.

FIG. 6 shows the center o of the rotary piston shown in FIG. 4 overlaying the center o' of the cylinder shown in FIG. 5. As understood from FIG. 6, a distance between the rotary piston and the cylinder is equal to a gyrating radius and is set to ϵ. Preferably, this distance is set to ϵ in the total periphery. However, within the range that the working chamber formed by the outer peripheral contour of the rotary piston and the inner peripheral contour of the cylinder is normally operated, it may be allowed that this relationship is not established for any reason.

The method for combining a plurality of arcs is explained as the method for constructing the contour shapes of the rotary piston and the cylinder, but the present invention is not limited by this method. It is possible to construct a similar contour shape by combining arbitrary (a high-order) curves.

Figure 7:
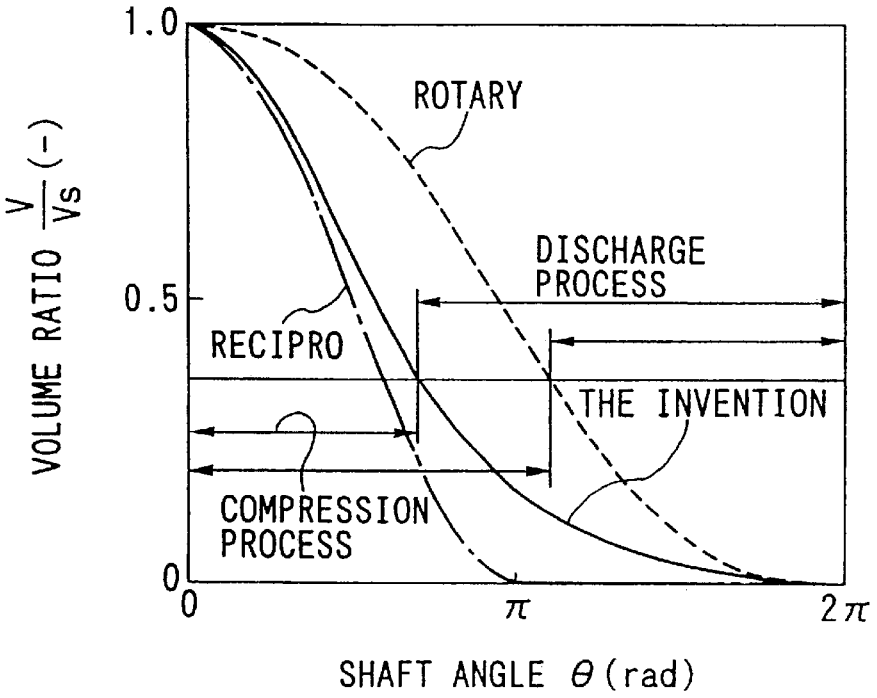
FIG. 7 is a view showing a characteristic of displacement variation of the working chamber according to the present invention.

FIG. 7 shows a characteristic of displacement variation of the working chamber according to the present invention (represented by the ratio of the suction displacement Vs to the working chamber displacement V) compared to other type of compressor by defining the shaft angle θ from the suction completion as a transversal axis. Thereby, the characteristic of displacement variation of the rotary type compression element 1 according to the embodiment is compared to the compressor in the condition of the air conditioner having the displacement ratio at the suction start of 0.37 (for example, in case that the working gas is HCFC 22, the suction pressure Ps=0.64 MPa, the discharge pressure=2.07 MPa). In this case, the compression process is substantially equal to the compression process of the recipro type. It is possible to reduce the leakage of the working gas and to enhance an ability and the efficiency of the compressor, since the compression process is completed. On the other hand, the discharge process is about 50% longer than the rotary type (the rolling piston type), since the flow velocity of the discharge gets more slowly, it is possible to reduce the pressure loss, further to largely reduce the fluid loss of the discharge process (over-compression loss) and to enhance the performance.

Figure 8:
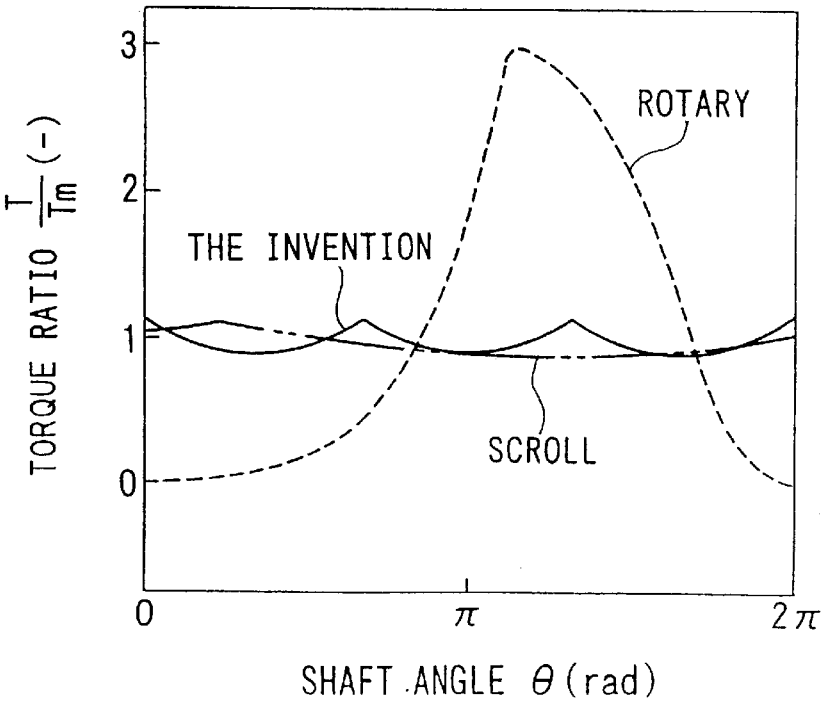
FIG. 8 is a view showing variation of the gas compression torque according to the present invention.

FIG. 8 shows a variation of a work amount during one rotation of the shaft according to the embodiment, that is, the variation of a gas compression torque T is compared to that of other type compressor (where Tm is an average torque). Thereby, the torque variation of the rotary type compression element 1 according to the present invention is 1/10 of the rotary type, that is, the torque variation is very small and substantially equal to that of the scroll type. However, since the compressor according to the present invention does not have a mechanism for reciprocating in order to prevent the rotary scroll rotation such as an Oldam's ring of the scroll type, it is possible to completely balance the shaft system and to reduce the vibration and noise of the compressor. Also, since the compressor according to the present invention is not a long spiral shape such as the scroll type, it is possible to reduce a working time and a cost. Further, since there is not the end plate (a mirror plate) for holding the spiral shape, it is possible to prepare by the work similarly to the rotary type compared to the scroll type which can not work by passing the jig through. Further, since a thrust load is not applied so that it is easy to manage the clearance in the direction of the shaft largely affecting the performance of the compressor, it is possible to enhance the performance. Further, it is possible to downsize and lighten the compressor.

Next, the relationship between the above wrap angle θ and the shaft angle θc from the suction completion to the discharge completion will be explained in detail. By changing the wrap angle θ, it is possible to change the shaft angle θc. For example, when the wrap angle is changed to less than the wrap angle of 360° so that the shaft angle from the suction completion to the discharge completion is changed to be small, the discharge port is linked through the suction port. Thereby, the fluid in the discharge port is expanded so that there is a problem that once sucked fluid is flowed back. Also, when the shaft angle from the suction completion to the discharge completion is changed to more than the wrap angle of 360° so that the shaft angle is changed to be large, two working chambers, each having different size, respectively, are formed while the fluid is passed through the space of the suction port from the suction completion. Thereby, when the fluid machine is used as the compressor, each pressure in these two working chambers rises differently from each other. Accordingly, when these two working chambers are combined with each other, since an irreversible mixture loss is occurred, a compression power is increased and further a rigidity of the rotary piston is reduced. Also, if attempting to use the fluid machine as a hydro pump, since the chamber which does not link through the discharge port is formed, the fluid machine can not be used as the pump. Thus, preferably, the wrap angle e is 360° within the range of an allowed precision.

According to the fluid machine described in the above described Japanese Patent Publication No. 55-23358 (citation 1), the shaft angle θc of the compression process is set to θc=180°. According to the fluid machine described in the above described Japanese Patent Publication No. 5-202869 (citation 3) and No. 6-280758 (citation 4), the shaft angle θc of the compression process is set to θc=210°. The period from the discharge completion of the working fluid to next compression process start (the discharge completion) is the shaft angle θc of 180° according to the citation 1, and the shaft angle θc of 150° according to the citations 3 and 4.

Figure 9A:
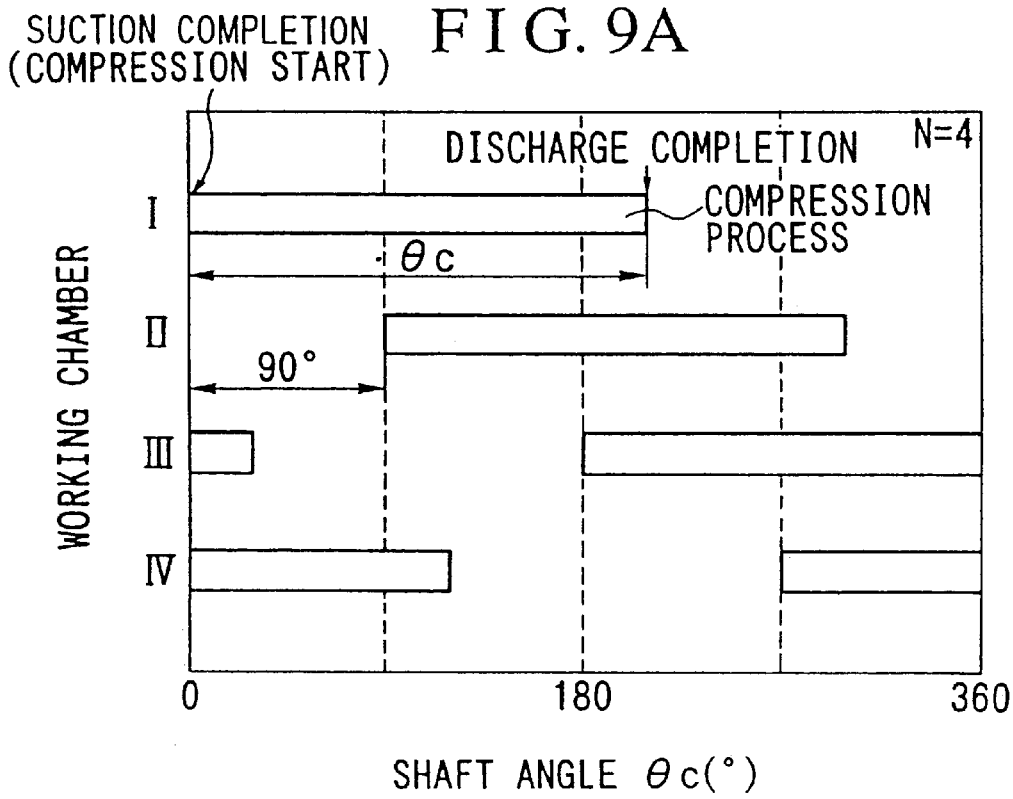
FIGS. 9A and 9B are views showing a relationship between the shaft angle and the working chamber in a four-threaded wrap.

FIG. 9A shows the compression process of each working chamber (shown by references I, II, III, IV) during one rotation of the shaft in case that the shaft angle θc of the compression process is θc=210°. Where, the number of threads N=4. Although four working chambers are formed within the range of the shaft angle θc of 360°, the number n of the simultaneously formed working chambers is n=2 or 3 in case of a particular angle. Accordingly, the maximum value of the number of the simultaneously formed working chambers is 3, that is, less than the number of threads.

Similarly, FIG. 10 shows the number of the working chambers in case that the number of threads N=3 and the shaft angle θc of the compression process is θc=210°. In this case, the number of the simultaneously formed working chambers n is n−1 or n−2. Accordingly, the maximum value of the number of the simultaneously formed working chambers is 2, that is, less than the number of threads.

In the above case, since the working chambers are inclined to be formed around the drive shaft, a dynamic unbalance is occurred. Thereby, the rotating moment acting on the rotary piston is excessively high so that a contact load between the rotary piston and the cylinder is increased. Accordingly, there are problems that the performance is reduced due to an increased machine friction loss and the reliability is reduced due to the abrasion of the vane.

In solve the above problem, the shaft angle θc of the compression process is satisfied with the following algorithm.

$$(((N-1)/N\cdot 360°)<\theta c\leqq 360° \qquad \text{(algorithm 1)}$$

Figure 9B:
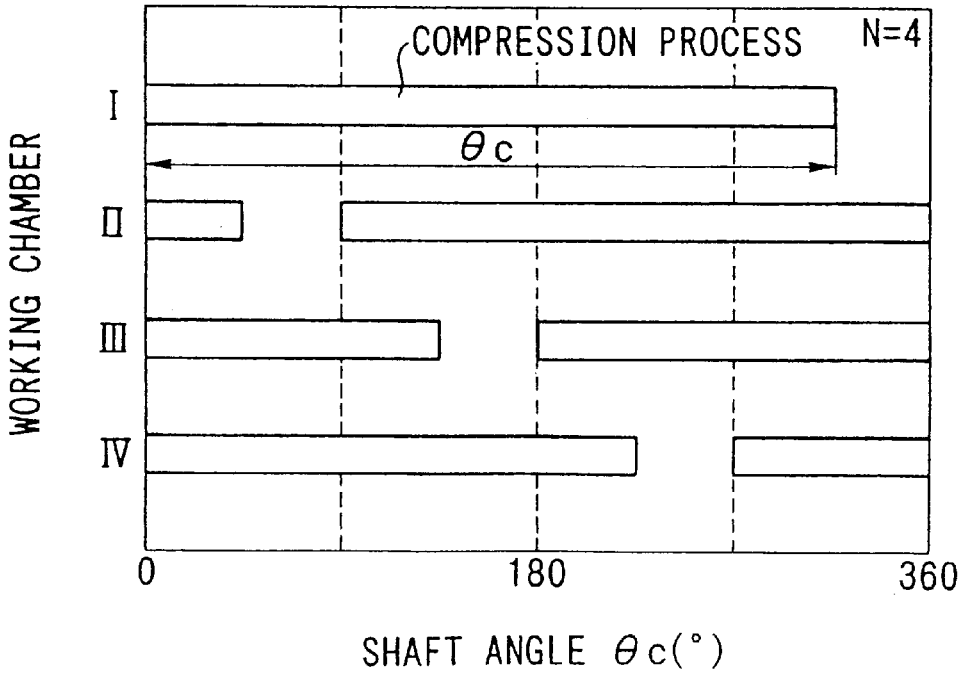

Thereby, the outer peripheral contour shape of the rotary piston and the inner peripheral contour shape are formed. In other words, the above wrap angle θ is within the range given by the algorithm 1. Referring to FIG. 9B, the shaft angle θc is more than 270°. The number n of the simultaneously formed working chambers is n=3 or 4 so that the maximum value of the working chambers is 4. This value corresponds to the number of threads N (=4). Also, in FIG. 10B, the shaft angle θc of the compression process is more than 240°. Accordingly, the number n of the simultaneously formed working chambers is n=2 or 3 so that the maximum value of the working chambers is 3. This value corresponds to the number of threads N (=3).

In this manner, the lowest value of the shaft angle θc of the compression process is more than the value given by the left side of the algorithm 1 so that the maximum value of the number of working chambers is more than the number of threads N. Thereby, the working chambers can be dispersed and located around the drive shaft so that it is possible to be dynamically balanced. Accordingly, it is possible to reduce the rotating moment acted on the rotary piston, to reduce the contact load between the rotary piston and the cylinder. Thereby, it is possible to enhance the performance because of the machine friction loss and further the reliability of the contact portion.

On the other hand, the upper value of the shaft angle θc of the compression process is 360° according to the algorithm 1. Ideally, the upper value of the shaft angle θc of the compression process is 360°. As described above, the time lag from the discharge completion of the working fluid to next compression process start (the suction completion) can be 0. It is possible to prevent from reducing the suction efficiency due to a gas re-expansion in a spaced displacement occurred in case of θc<360°. Further, it is possible to prevent from the irreversible mixture loss due to each of different pressure risen in the two chambers in combining these chambers in case of θc>360°. The latter case will be explained in reference with FIG. 11.

Figure 11:
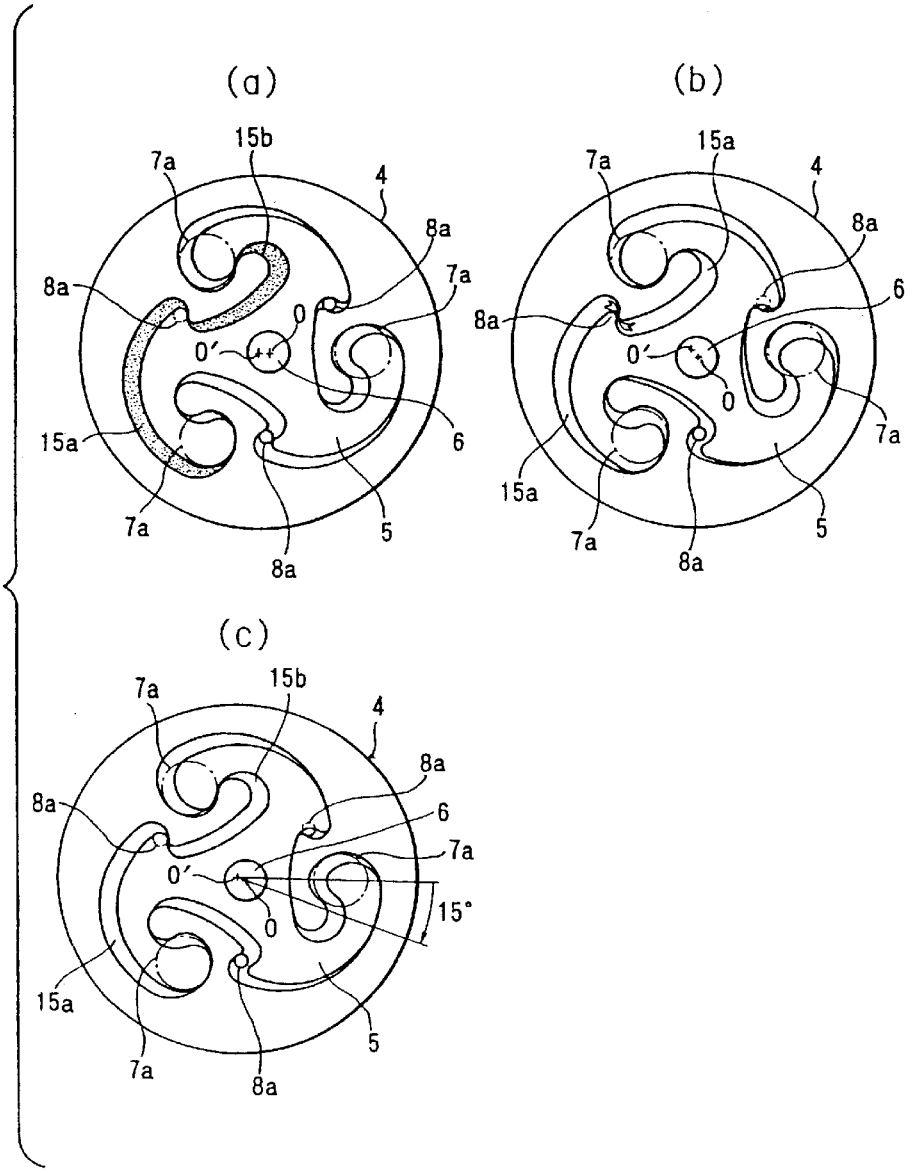
FIG. 11 is a view for explaining operation in case that a wrap angle of the compression element is more than 360°.

The shaft angle θc of the compression process of the displacement fluid type machine shown in FIG. 11 is 375°. FIG. 11A shows the suction completion in two working chambers 15*a* and 15*b* shaded in FIG. 11A. At this time, the pressures in both of working chambers 15*a* and 15*b* are equal and the suction pressure Ps. The discharge port 8*a* is located between two working chambers 15*a* and 15*b*, and is not linked though both of the chambers. FIG. 11B shows that the shaft angle θc is rotated in 15° from the state shown in FIG. 11A. FIG. 11B shows the state immediately before the working chambers 15*a* and 15*b* are linked through each other. At this time, the displacement of the working chamber 15*a* is less than the displacement in the suction completion shown in FIG. 11A, the compression proceeds, and the pressure is higher than the suction pressure Ps. On the contrary, the displacement of the working chamber 15*b* is more than the displacement in the suction completion, and the pressure is lower than the suction pressure Ps due to the expansion. Next, the instant the working chambers 15*a* and 15*b* are combined with (linked through) each other, the irreversible mixture occurs as shown by an arrow in FIG. 11*c*. Thereby, the pressure power is increased so that the performance is reduced. Accordingly, preferably, the upper limitation of the shaft angle θc of the compression process is 360°.

The displacement type fluid machine shown in FIG. 11 is slightly different from that shown in FIG. 1. In the displacement type fluid machine shown in FIG. 1, one space of two spaces which the vane is located between is a suction space, and the other space is the working chamber. The shape of such a thin vane is varied so that the inner leakage occurs, thereby there is the problem that the compression efficiency is reduced. In order to solve this problem, the form shown in FIG. 11 is formed. If the shaft angle θc of the compression process of the displacement type fluid machine shown in FIG. 11 is 360°, the displacement type fluid machine shown in FIG. 11 has a substantially same characteristic as that shown in FIG. 1. Also, the rotary pistons of the displacement type fluid machines shown in FIGS. 1 and 11 are commonly shaped so that the thread is extended from the center portion and both of the rotary pistons have a narrow portion.

Figure 10A:
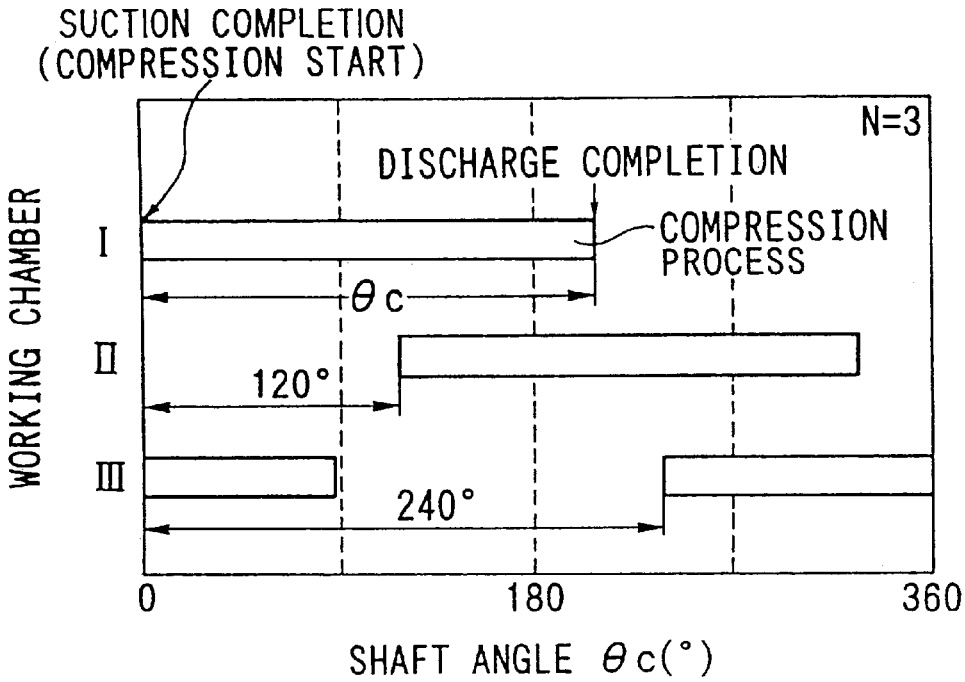
FIGS. 10A and 10B are views showing a relationship between the shaft angle and the working chamber in a three-threaded wrap.
Figure 10B:
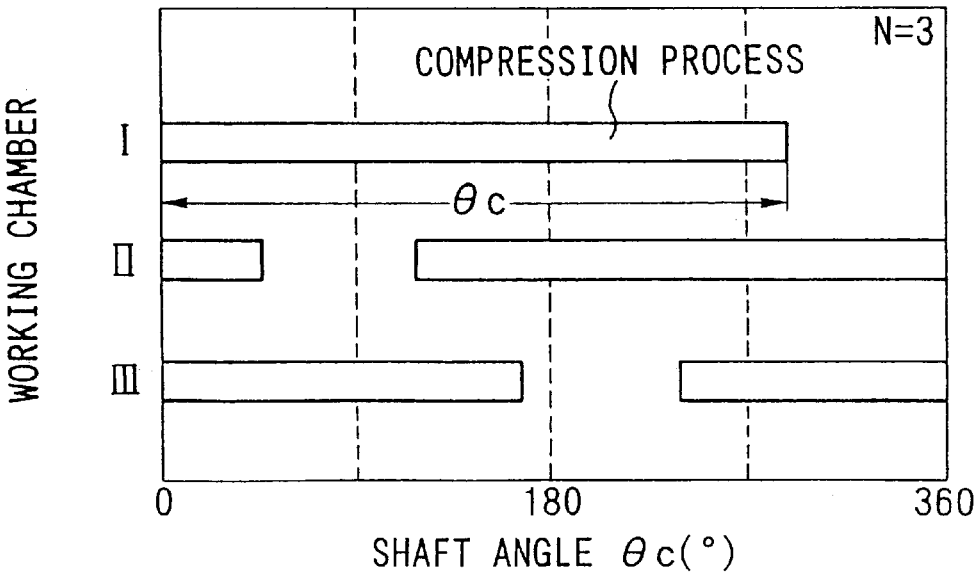
Figure 12A:
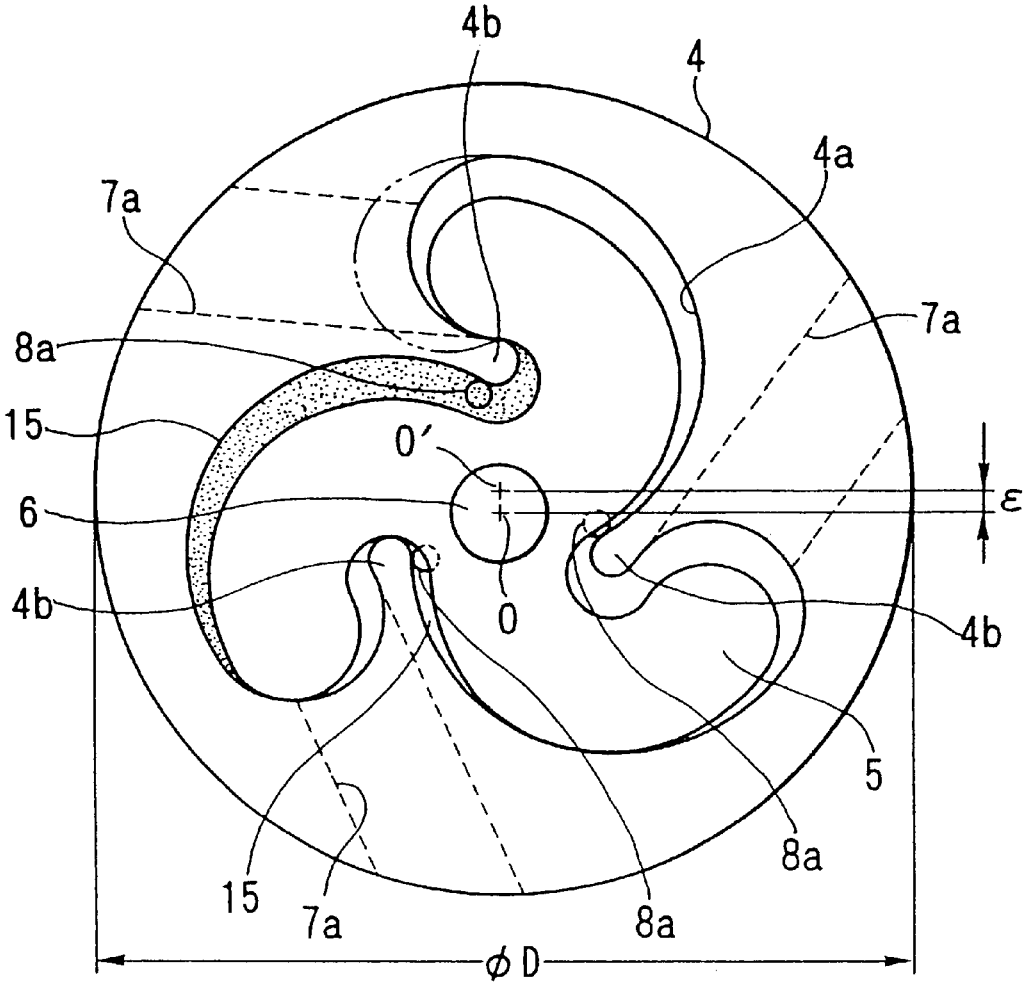
FIGS. 12A and 12B are views for explaining enlargement of the wrap angle of the compression element.
Figure 12B:
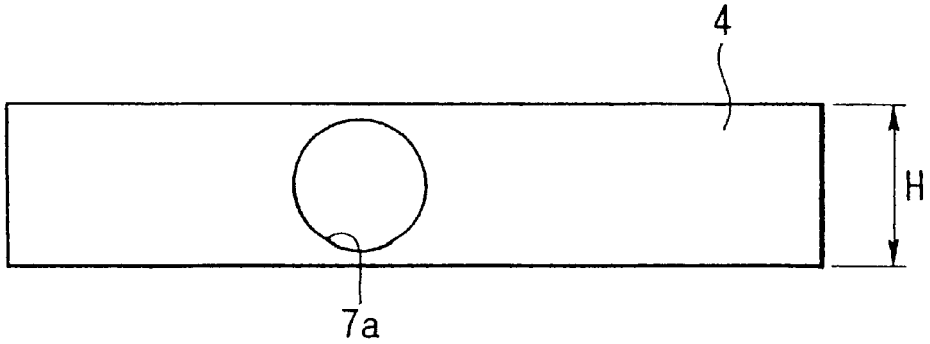

FIG. 12 shows the compression element of the rotary type fluid machine described in the citations 3 and 4. FIG. 12A shows a plan view, FIG. 12B shows a side view. The number of threads N is 3, and the shaft angle θc (the wrap angle θ) of the compression process is 210°. In FIG. 12, the number n of the working chambers is n=1 or 2 as shown in FIG. 10A. FIG. 12 shows that the shaft angle θc is 0°, and the number n of the working chambers is 2. As be apparent in FIG. 12, the right space of the spaces formed by the outer peripheral contour shape of the rotary piston and the inner peripheral contour shape of the cylinder is not the working chamber, and the suction port 7*a* and the discharge port 8*a* are linked through each other. Thus, the gas in the spaced displacement of the discharge port 8*a* is re-expanded so that the gas flowed into the cylinder 4 from the discharge port 8*a* is flowed back, thereby there is the problem that the suction efficiency is reduced.

By the way, the shaft angle θc of the compression process of the displacement type fluid machine shown in FIG. 12 will be extended by considering the embodiment. In order to extend the shaft angle θc of the compression process, the wrap angle of the contour curve of the cylinder 4 must be larger as shown by a double-dot line. Thereby, the thickness of the vane 4*b* is excessively thin as shown in FIG. 12. Accordingly, it is difficult that the shaft angle θc of the compression process is changed to be more than 240° in order that the maximum value of the number n of the working chambers is more than the number of threads N (N=3).

Figure 13A:
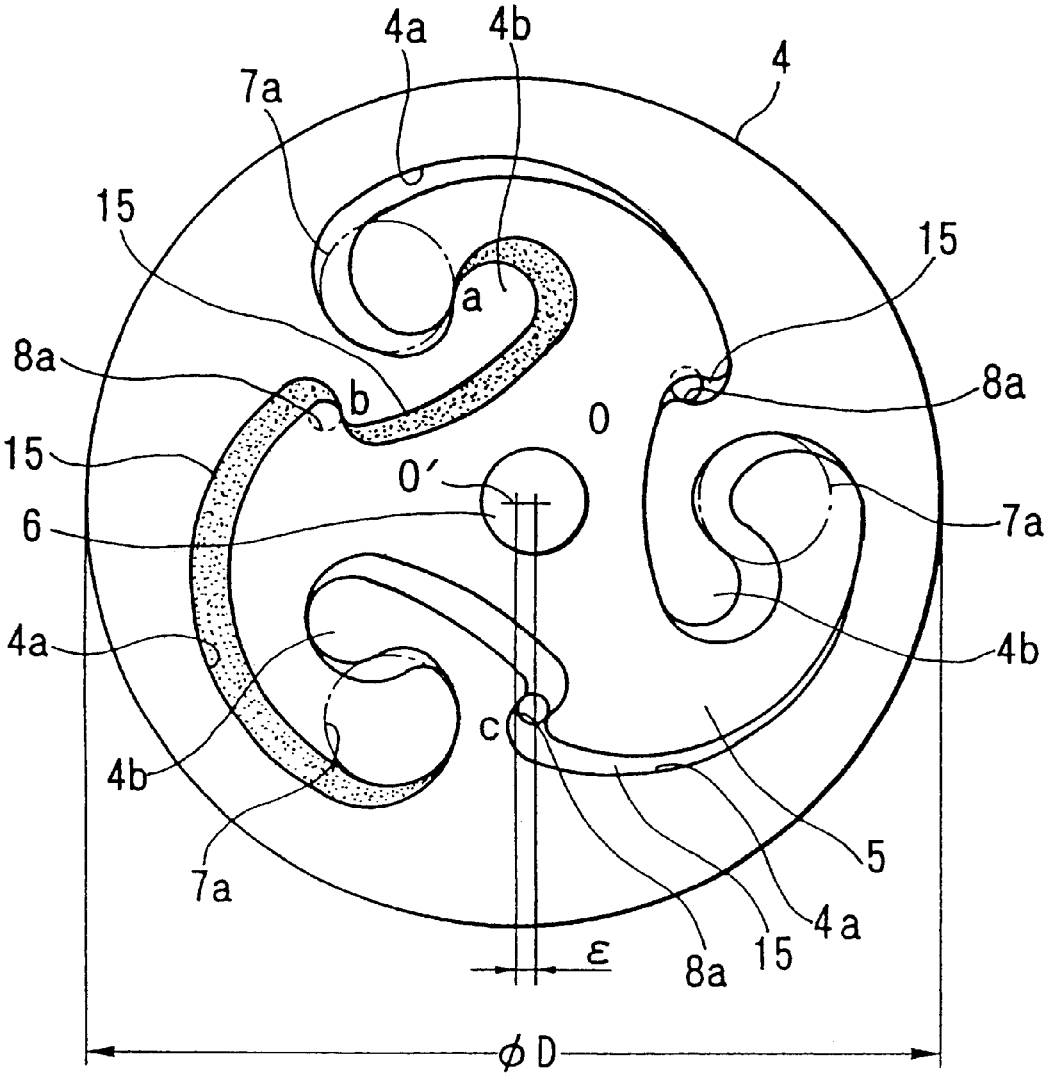
FIGS. 13A and 13B are views showing a modification of the displacement type fluid machine shown in FIG. 1.
Figure 13B:
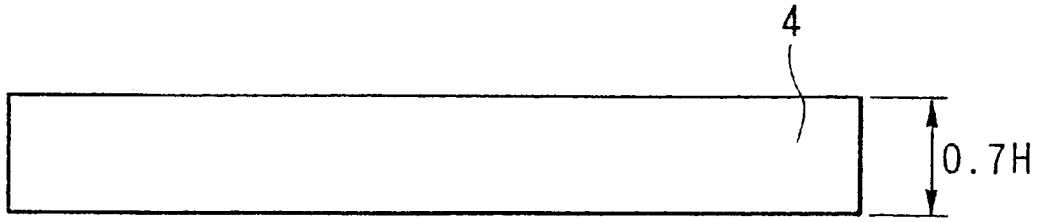

FIG. 13 shows the embodiment of the compression element of the displacement type fluid machine having the same process displacement (the suction displacement), the same outer diameter and the same rotary radium as those of the displacement type fluid machine shown in FIG. 12. The shaft angle θc of the compression process of the compression element shown in FIG. 13 can be 360°, that is, more than 240°. Since the compression element shown in FIG. 12 comprises the smooth curves between sealing points which form the working chambers, even if the shaft angle θc of the compression process is attempted to be enlarged according to the embodiment, the maximum value of the shaft angle θc is at most 240°. However, since the compression element according to the embodiment shown in FIG. 13 does not have the smooth curves between the sealing points (the point a–the point c) (that is, does not have the similar curve), the shape near the point b is extruded relative to the rotary piston. Further, the narrow portion exists on the way from the center portion to the end portion of each thread. This can be also described according to the embodiment shown in FIG. 1. Due to these shapes, the wrap angle θ from the engaging point a to the engaging point b can be 360°, that is, can be more than 240°. Further, the wrap angle θ from the engaging point b to the engaging point c can be 360°, that is, can be more than 240°. Consequently, the shaft angle θc of the compression process can be 360° more than 240° so that the maximum value of the number n of the working chambers can be more than the number of threads N. Thus, it is possible to disperse the working chambers so that the rotating moment can be reduced.

Further, since the number of the working chambers which functions effectively is increased, when a height (thickness) of the cylinder of the compression element shown in FIG. 12 is set to H, the height of the cylinder of the compression element shown in FIG. 13 is 0.7H and is 30% lower than that in FIG. 12. Accordingly, it is possible to downsize the compression element.

Figure 14:
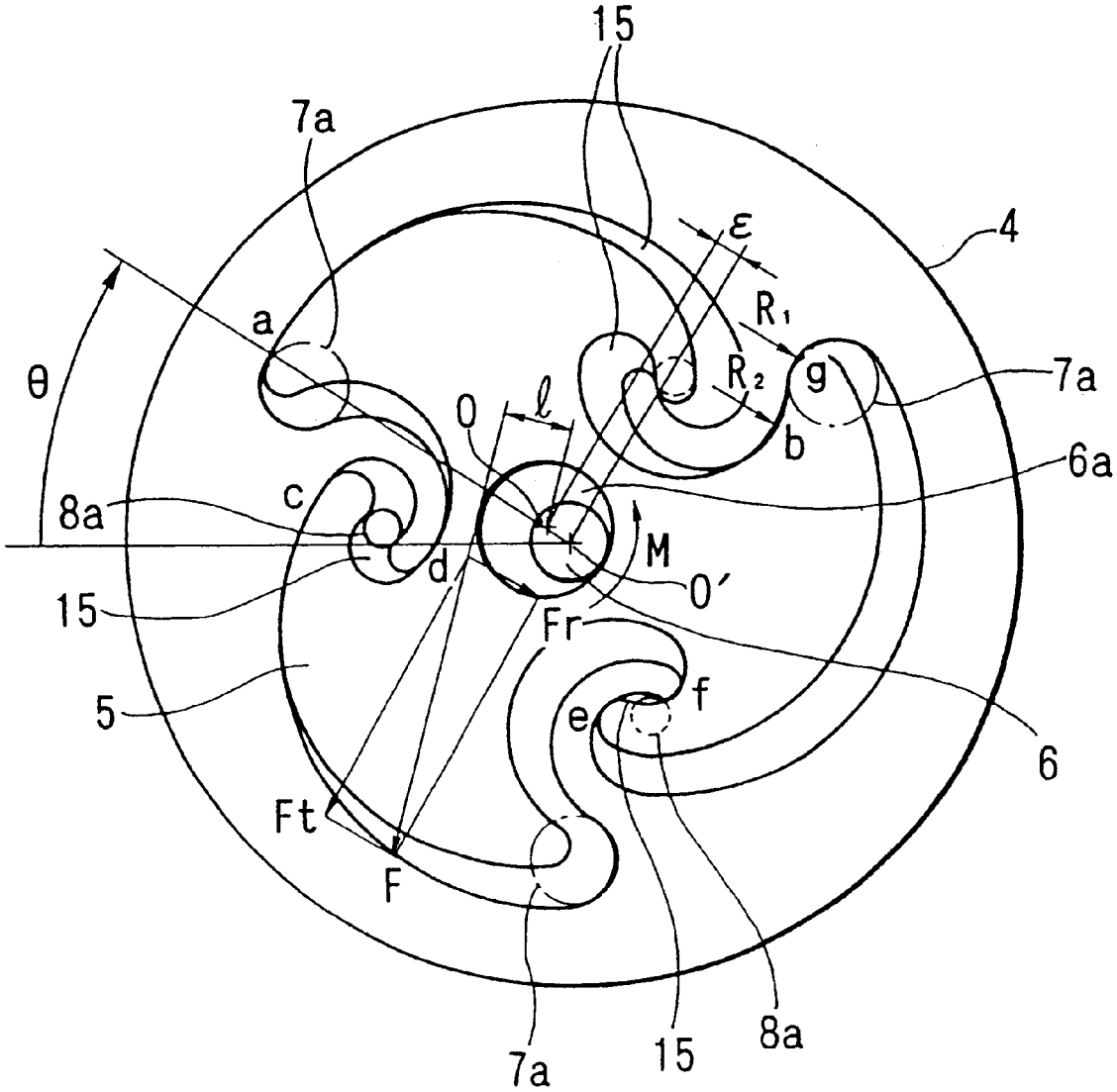
FIG. 14 is a view for explaining a load and a moment applied to the rotary piston according to the present invention.

FIG. 14 shows the load and the moment applied to the rotary piston 5 according to the embodiment. A reference θ denotes the shaft angle of the drive shaft 6, and a reference δ denotes the rotary radius. By an internal pressure in each working chamber 15 accompanied with the working gas compression, a force Ft in the direction of the tangent line perpendicularly to the direction of an eccentricity and a force Fr in the direction of the radius corresponding to the direction of the eccentricity are applied to the rotary piston 5. A resultant force of Ft and Fr is F. This resultant force F is shifted relative to the center o of the rotary piston 5 (a length of an arm is 1) so that a rotating moment M is acted in order to rotate the rotary piston. This rotating moment M is supported by a reaction force R1 and a reaction force R2 at the engaging points g and b. According to the present invention, the moment is applied at two or three engaging points near the suction port 7*a*, and the reaction force is not acted at other engaging points. In the rotary type compression element 1 according to the present invention, the working chambers are dispersed and located around the crank portion 6*a* of the drive shaft 6 engaged with the center portion of the rotary piston 5 at substantially equal pitch so that the shaft angle from the suction completion to the discharge completion is substantially 360°. Accordingly, an action point of the resultant force F can be approached to the center o of the rotary piston 5 so that it is possible to reduce the length of the arm 1 of the moment and to reduce the rotating moment M. Accordingly, it is possible to reduce the reaction forces R1 and R2. Also, as understood by the locations of the engaging points g and b, since sleeve parts of the rotary piston 5 and the cylinder 4 applied by the rotating moment M is near the suction port 7*a* for the working gas having a low temperature and a high oil viscosity, an oil film can be ensured so that it is possible to provide the more reliable rotary type compressor for solving the problem of the friction and the abrasion.

Figure 15:
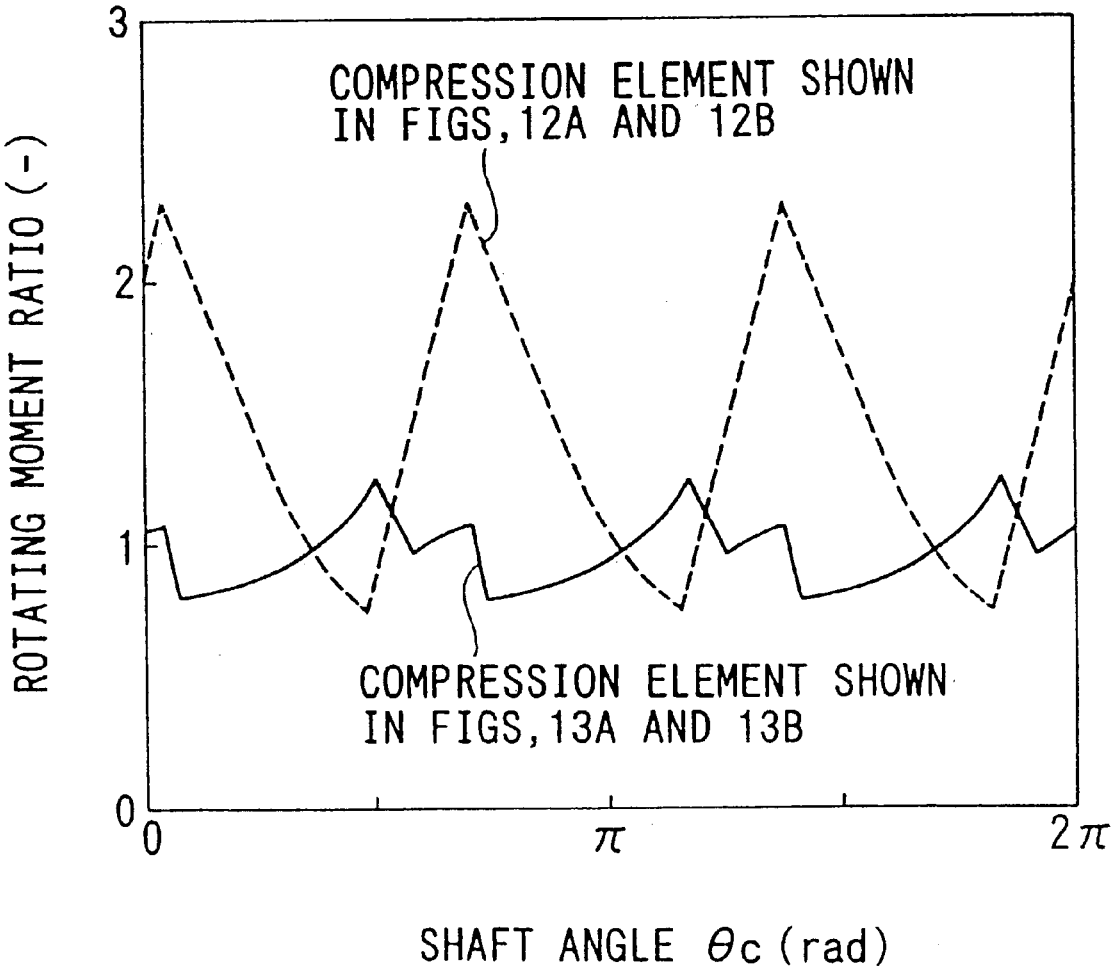
FIG. 15 is a view showing a relationship between the shaft angle of the compression element and a rotating moment ratio.

FIG. 15 shows that the rotating moment M during one rotation of the shaft acting on the rotary piston by the internal pressure of the working fluid is compared to the compression elements shown in FIGS. 12 and 13. A calculation condition is a refrigeration condition of the working fluid HFC134a (where, the suction pressure Ps=0.095 Mpa, the discharge pressure Pd=1.043 Mpa). Thereby, according to the compression element of the embodiment having the maximum value of the working chambers more than the number of threads, since the working chambers from the suction completion to the discharge completion are dispersed and located around the drive shaft at substantially equal pitch, it is possible to be dynamically balanced so that the load vector by the compression can be pointed toward the substantial center. Thus, it is possible to reduce the rotating moment M acted on the rotary piston. Consequently, it is possible to reduce the contact load of the rotary piston and the cylinder, to enhance the machine efficiency and further to enhance the reliability as the compressor.

The relationship between the period that the suction port 7*a* is linked through the discharge port 8*a* and the shaft angle of the compression process will be now explained. The period that the suction port 7*a* is linked through the discharge port 8*a*, that is, the time lag Δθ represented by the shaft angle during the period from the discharge completion of the working fluid to next compression start (the suction completion) is represented by Δθ=360°−θc as the shaft angle θc of the compression process.

In case of Δθ≦0°, since the period that the suction port is linked through the discharge port does not exist, the suction efficiency is not reduced due to the re-expansion of the gas in the spaced displacement of the discharge port.

In case of Δθ>0°, since the period that the suction port is linked through the discharge port exists, the suction efficiency is reduced due to the re-expansion of the gas in the spaced displacement of the discharge port. Thereby, a refrigeration ability of the compressor is reduced. Also, due to the reduction of the suction efficiency (the volume efficiency), an adiabatic efficiency, that is, an energy efficiency of the compressor, or a result coefficient is also reduced.

The shaft angle θc of the compression process is determined by the wrap angle θ of the contour curve of the rotary piston or the cylinder and the locations of the suction port and the discharge port. In case that the wrap angle θ of the contour curve of the rotary piston or the cylinder is 360°, the shaft angle θc of the compression process can be 360°. Further, the sealing point of the suction port or the discharge port is moved so that Δθ<360° may be set. However, Δθ>360° can not be set. For example, the location and size of the discharge port is changed so that it is possible to change the shaft angle θc=375° of the compression process of the compression element shown in FIG. 11 into the shaft angle θc=360°. Immediately after the suction completion in FIG. 11, the discharge port is enlarged so that the working chamber 15*a* can be linked through the working chamber 15*b* in order to change the shaft angle θc=375° into θc=360°. By this change, it is possible to reduce the irreversible mixture loss due to the differently rising pressures in the two working chambers occurred when the shaft angle is θc=375°. Accordingly, the wrap angle θ of the contour curve is a necessary condition, but a sufficient condition for determining the shaft angle θc of the compression process.

According to the above described embodiment, the sealing type compressor of a low pressure in the sealing container 3 (suction pressure) type is described above. The low pressure type compressor has the following advantages:

(1) Since the motor element 2 is less heated by the compressed working gas having a high temperature, the temperature of the stator 2*a* and the rotor 2*b* is fallen down so that the motor efficiency can be enhanced in order to enhance the performance.

(2) In the working fluid which is soluble in the lubricating oil 12 such as CFCs, etc., since the pressure is low, the ratio of the working gas melted in the lubricating oil 12 is less. Accordingly, the oil is less effervesced by the bearing, etc. so that it is possible to enhance the reliability.

(3) A pressure tightness in the sealing container 3 can be lower so that it is possible to slim and lighten the compressor.

Figure 16:
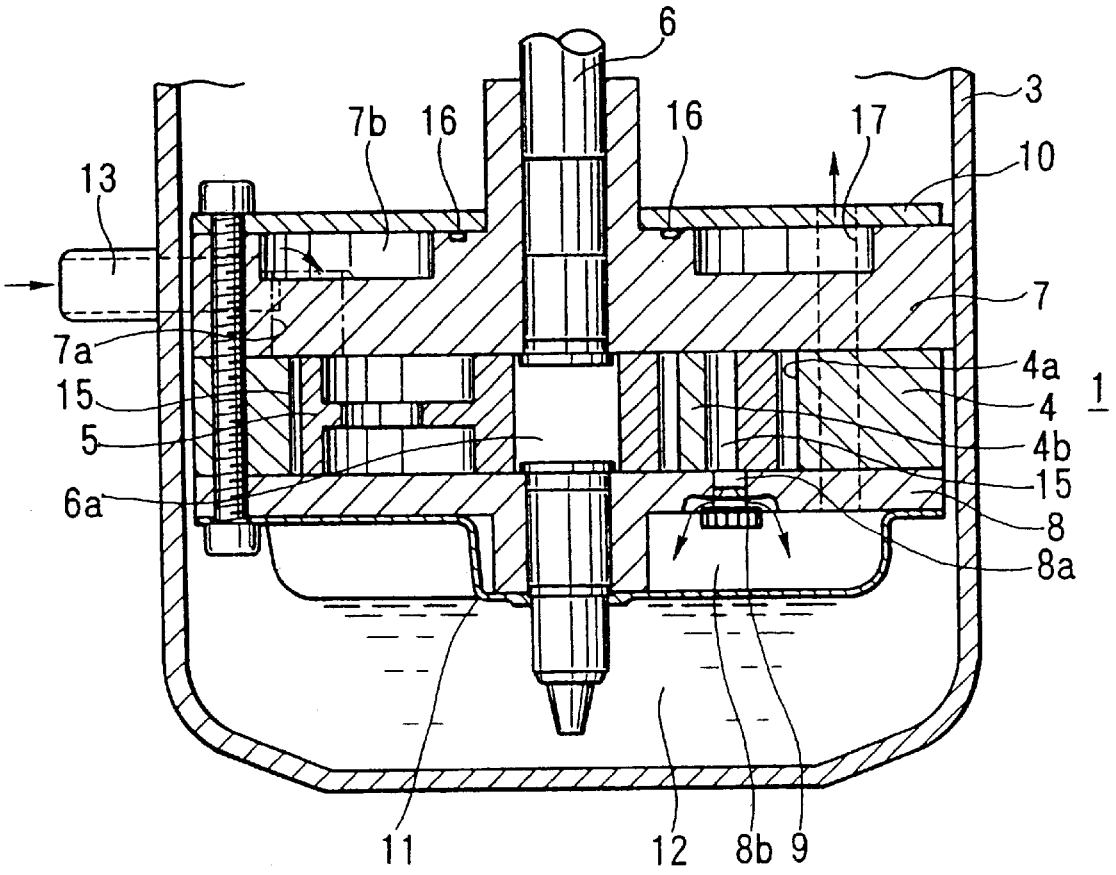
FIG. 16 is a partial vertical sectional view of the sealed type compressor according to another embodiment of the present invention.

Next, a high pressure in the sealing container 3 (discharge pressure) type compressor will be explained. FIG. 16 shows a partially enlarged sectional view of the sealing type compressor of the high pressure type in case that the rotary type fluid machine of another embodiment according to the present invention is used as the compressor. In FIG. 16, the elements having the same reference numbers in FIGS. 1–3 are the same portions and have the same action in FIG. 16. In FIG. 16, a numeral 7*b* denotes a suction chamber integrated with the main bearing 7 by the suction cover 10. The suction chamber 7*b* is divided from the pressure (the suction pressure.) in the sealing container 3 by the sealing member 16, etc. A numeral 17 denotes a discharge path through into the discharge chamber 8*b* and the sealing container 3. The principle of the work etc. of the rotary type compression element 1 is similar to that of the low pressure type (suction pressure) type.

As the flow of the working gas shown by an arrow in FIG. 16, the working gas passes through the suction pipe 13, enters into the suction chamber 7*b*, passes through the suction port 7*a* formed in the main bearing 7, and enters into the rotary type compression element 1, where the drive shaft 6 is rotated so that the piston 5 is gyrated. Thereby, the displacement of the working chamber 15 is reduced in order to compress the working gas. The compressed working gas passes through the discharge port 8*a* formed on the end plate of the auxiliary bearing 8, pushes up the discharge valve 9, enters into the discharge chamber 8*b*, passes through the discharge path 17, enters into the sealing container 3, and flows outwardly from the discharge pipe (not shown) connected to the sealing container 3.

Since the lubricating oil 12 is highly pressured, the drive shaft 6 is rotated so that a centrifugal pump etc. is operated in order to feed the lubricating oil 12 with each bearing sleeve portion, the fed lubricating oil 12 is passed through the space between the end surface of the rotary piston 5 so that it is easy to provide the lubricating oil 12 into the cylinder 4. Accordingly, it is possible to enhance a sealing ability of the working chamber 15 and a lubricating ability of the sleeve portion.

In the compressor using the rotary type fluid machine of the present invention, it is possible to select either the low pressure type or the high pressure type according to a specification, an application of an equipment or a manufacturing facility. Thereby, it is possible to flexibly design.

Figure 17:
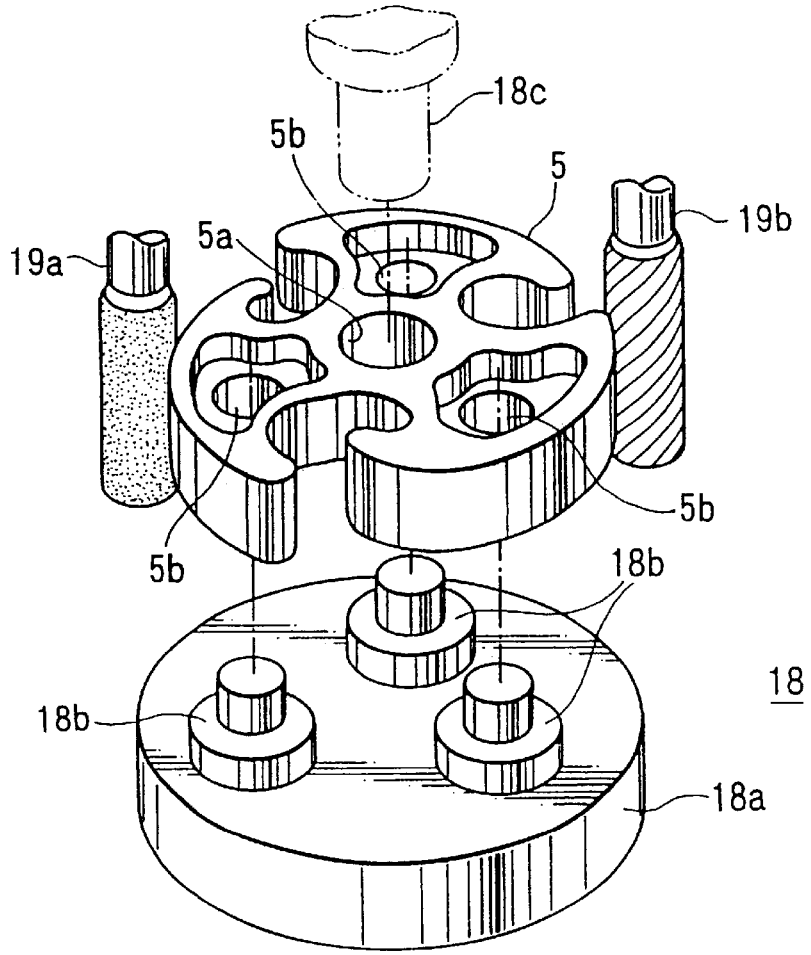
FIG. 17 is a view for explaining an outer peripheral contours work of the rotary piston according to the present invention.
Figure 18:
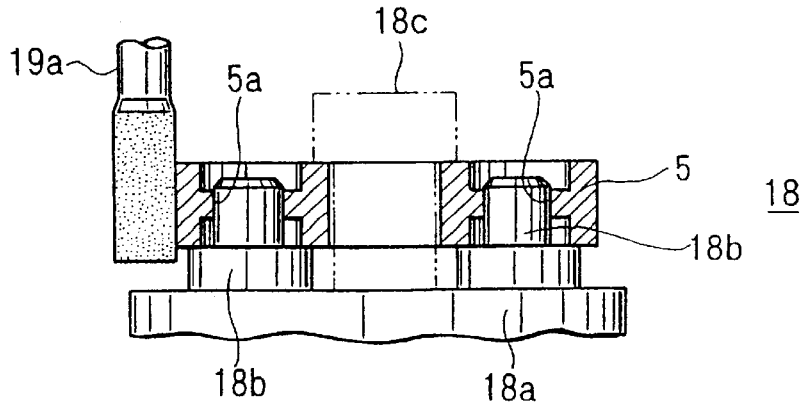
FIG. 18 is a sectional view of the piston according to the present invention to which a working jig is fitted.

Next, a method for preparing the rotary piston according to the embodiment of the present invention, more especially, a method for finishing the outer peripheral contour having the particular shape will be explained. FIG. 17 explains the method. FIG. 18 shows a sectional view of the piston whose outer periphery is worked. In FIG. 17, a numeral 18 denotes a working jig comprising a base 18*a*, a plurality of pin portions 18*b* fixed to the base 18*a*, and a clamp 18*c* for fixing the work. A numeral 19 denotes a working tool comprising a grinding tool 19*a*, a cutting tool 19*b*, etc. Both of end surfaces of a member of the rotary piston 5 which is made of a casting are worked the through hole 5*b* and the bearing 5*a* for positioning is positioningly worked with high accuracy. Next, as shown in FIG. 17, the member is engaged along the pin portion 18*b* of the working jig 18 by determining the through hole 5*b* as a positioning orientation, and is fastened and fixed to the base 18*a* by the clamp 18*c* by using a screw and a machine force. When the member is mounted to the base 18*a* (FIG. 18), by using a machining center etc., the outer peripheral contour is finished by the grinding tool 19*a*, the cutting tool 19*b*, etc. Thus, a plurality of through holes 5*b* are formed around the bearing 5*a* at the center portion of the rotary piston 5. Since this through hole 5*b* is determined as the positioning orientation for fitting to the working jig 18, it is possible to position with high accuracy. Further, it is possible to prevent from a deformation due to the cutting and grinding work, and further to enhance a dimension precision of the contour shape. Also, the through hole is used for fitting and further for positioning of a test jig so that it is possible to fit and test effectively. Further, it is possible to contribute to a reduction of a weight of the rotary piston 5. On the other hand, in order to work the inner peripheral contour of the cylinder 4, the outer periphery of the cylinder 4 is fixed to the fitting jig in order to work the inner peripheral contour of the cylinder 4 by using the machining center, etc. In order to enhance the rigidity of the vane 4*b* of the cylinder 4, the cylinder 4 may be adhered onto the end plate surface of the main bearing 7, or the cylinder 4 may be integrated with the main bearing 7.

The rotary type fluid machine having three vanes 4*b* on the inner periphery of the cylinder 4 is described above. The present invention can not be limited to this example. Accordingly, the rotary type fluid machine having N vanes 4*b* (N is more than 2) may be applied (the value of N is practically less than 8–10).

Figure 19:
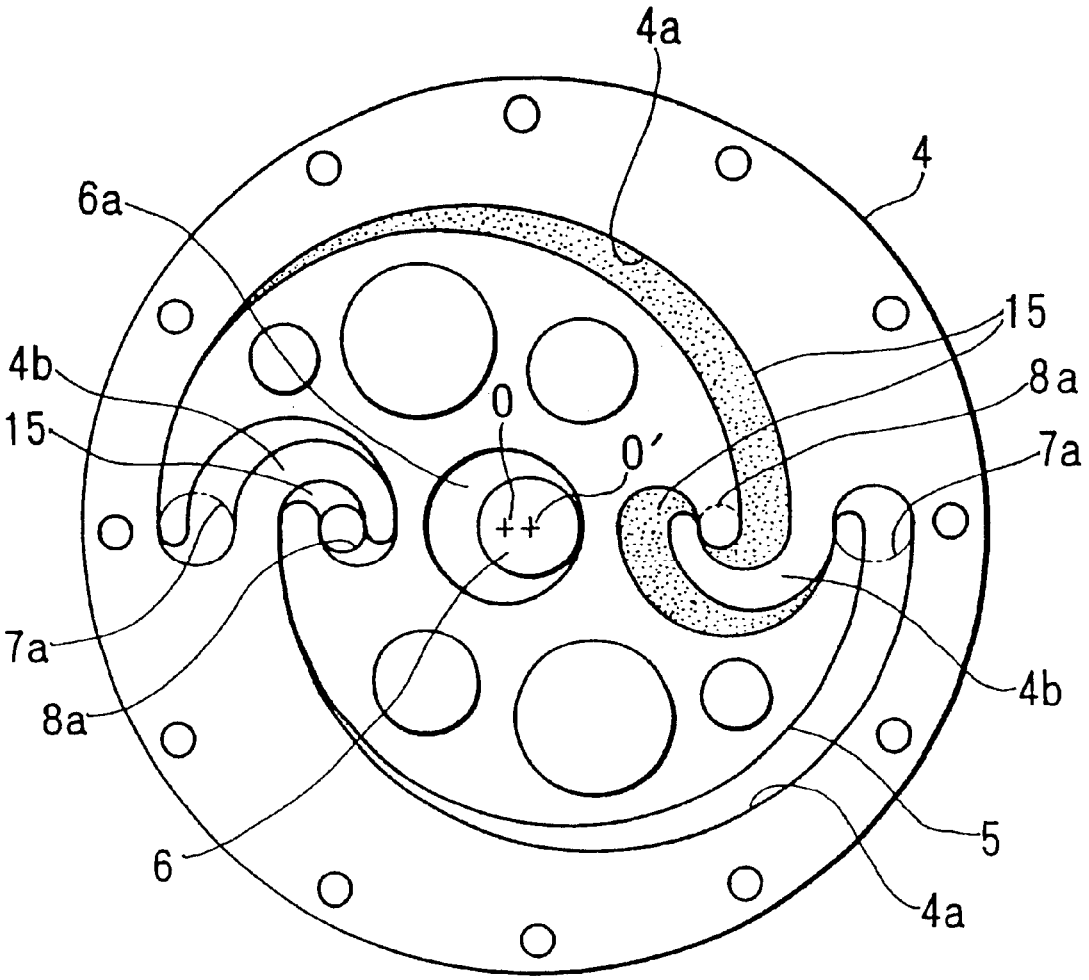
FIG. 19 is a view of the compression element of the rotary type fluid machine according to another embodiment of the present invention in case of two working chambers.
Figure 20:
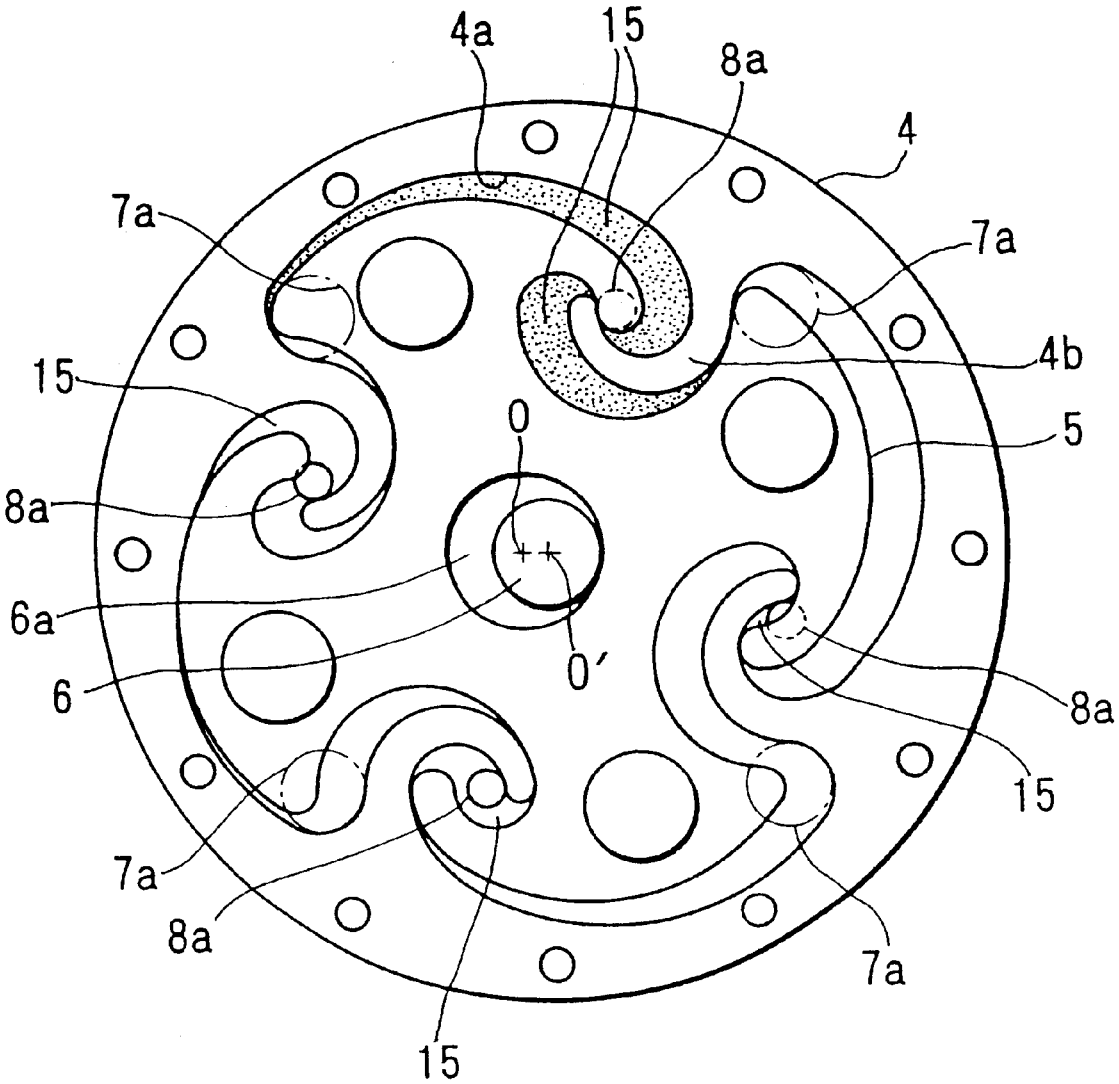
FIG. 20 is a view showing a compression element of the rotary type fluid machine according to another embodiment of the present invention in case of four working chambers.
Figure 21:
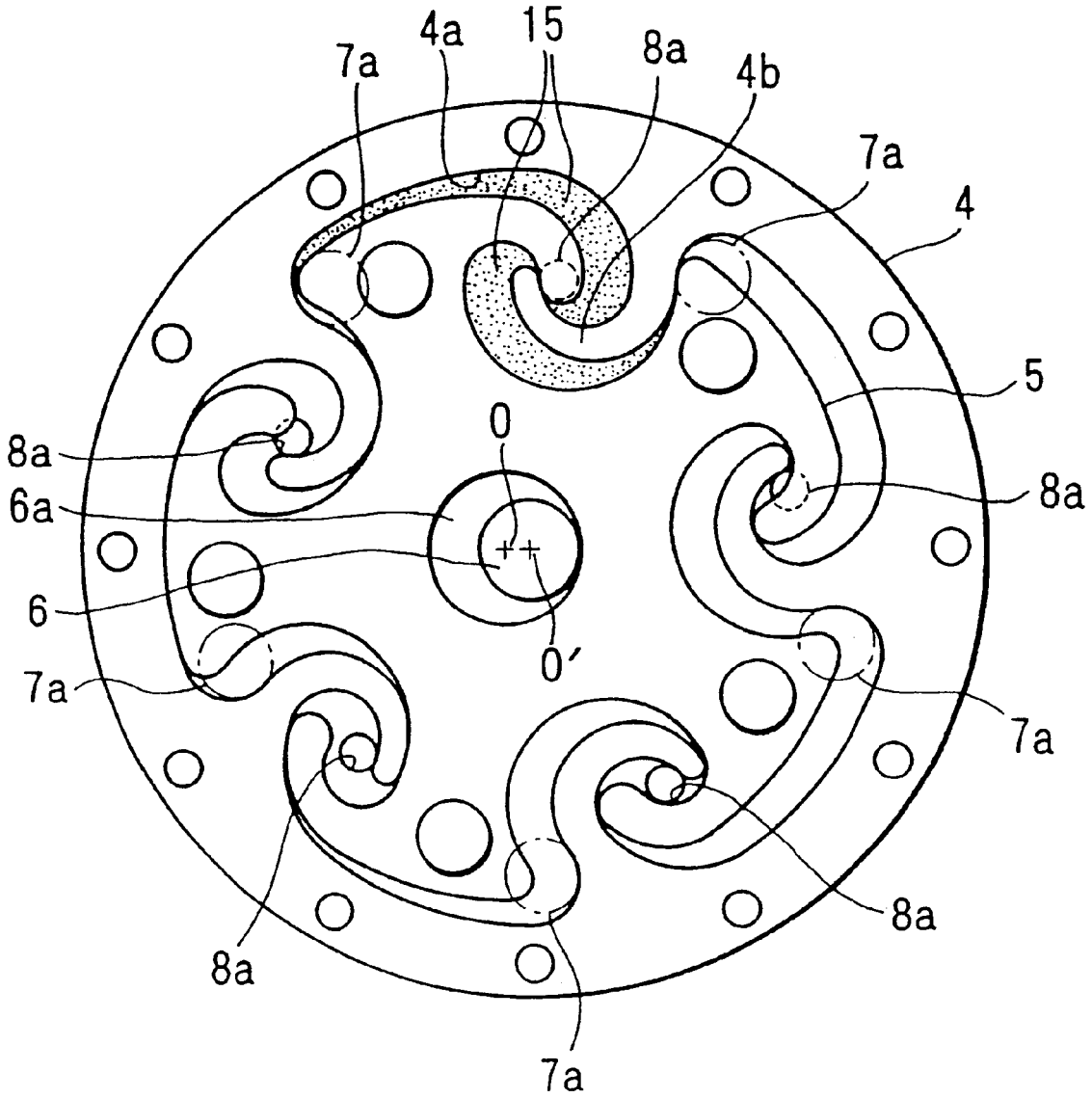
FIG. 21 is a view showing a compression element of the rotary type fluid machine according to another embodiment of the present invention in case of five working chambers.

FIGS. 19–21 show the compression element according to another embodiment of the present invention. FIG. 19 shows the case of N=2 (a double-thread wrap), FIG. 20 shows the case of N=4 (a four-thread wrap), and FIG. 21 shows the case of N=5 (a five-thread wrap). Since a basic principle of the work of the rotary type compression element 1 in FIGS. 19–21 is similar to that in FIG. 2, an explanation is omitted.

In this manner, as the number N of vanes gets higher within the applicable range, there are the following advantages.

(1) A torque variation is reduced so that it is possible to reduce the vibration and noise.

(2) Compared to the same outer diameter, the height of the cylinder for ensuring the same suction displacement Vs gets lower so that it is possible to downsize the compression element.

(3) Since the rotating moment applied to the rotary piston is reduced, it is possible to reduce a machine friction loss at the sleeve portion of the rotary piston and the cylinder, and further to enhance the reliability.

(4) The pressure pulsation in the suction and discharge pipe arrangement is reduced so that it is possible to further reduce the vibration and noise. Thereby, it is possible to realize the fluid machine (compressor, pump, etc.) having no pulsation flow required for a medical application, an industrial application, etc.

Figure 22:
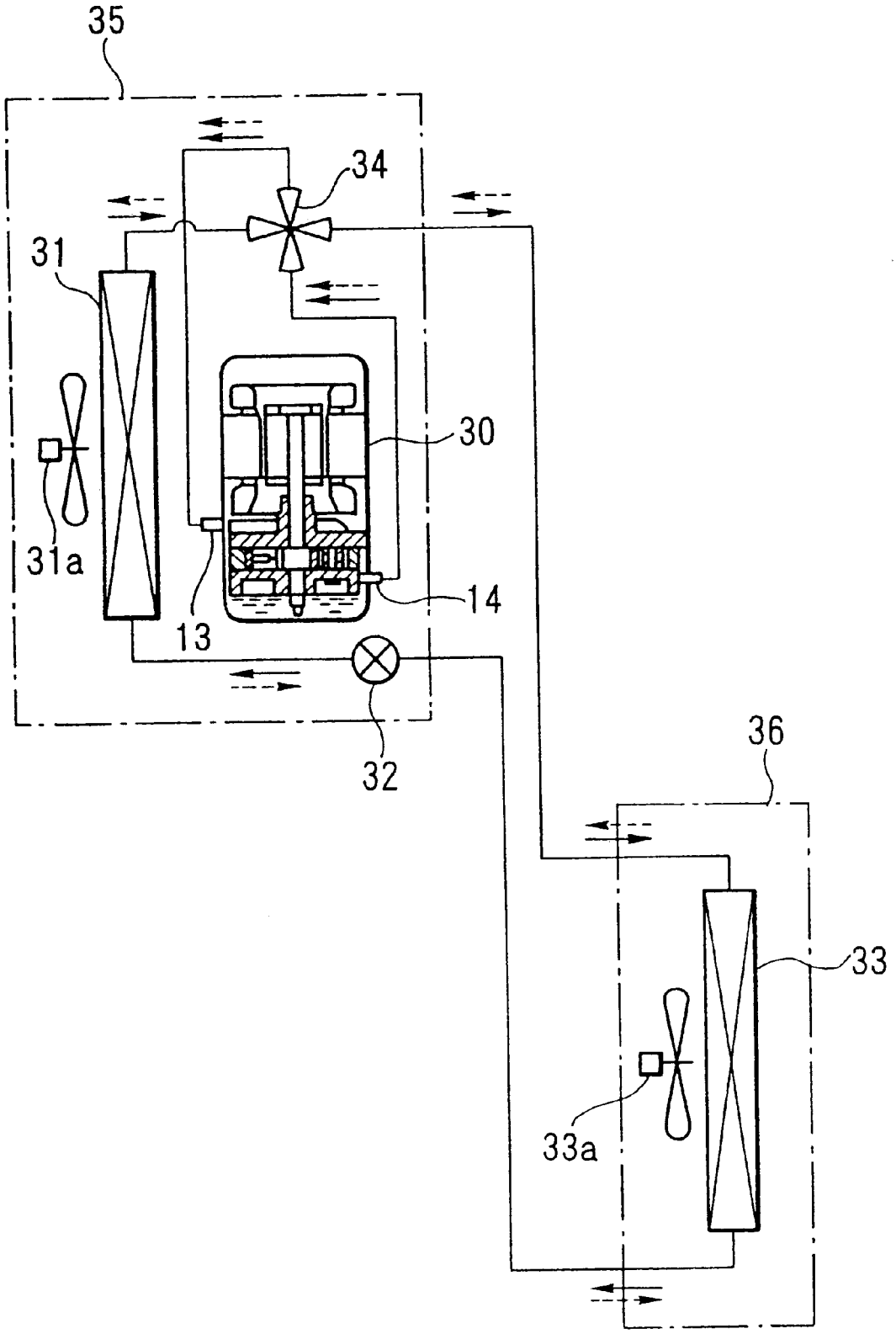
FIG. 22 is a view showing an air conditioner system using the rotary type compressor of the present invention.

FIG. 22 shows the air conditioner system using the rotary type compressor of the present invention. This cycle is a heat pump cycle for a cooling and heating machine, and comprises a rotary type compressor 30 of the present invention shown in FIG. 3, an outdoor heat exchanger 31, a fan 31*a* of the outdoor heat exchanger 31, an expansion valve 32, an indoor heat exchanger 33, a fan 33*a* of the indoor heat exchanger 33, and four rectangular valve 34. A single-dot line 35 shows an outdoor unit, and a single-dot line 36 is an inside unit.

The rotary type compressor 30 is operated according to the principle of the work shown in FIG. 2. The compressor is started so that the working fluid (HCFS22, R407C, R410A, etc.) is compressed between the cylinder and the rotary piston.

In case of operating the cooling machine, as shown by a dotted line arrow, the compressed working gas having the high temperature and high pressure passes through the four rectangular valve 34 from the discharge pipe 14, and flows into the outdoor heat exchanger 31. Further, the working gas is blown by the fan 31*a* so that the heat is radiated, the working gas is liquefied, is throttled by the expansion valve 32, is adiabatically expanded, is changed to the low temperature and low pressure, absorbs a heat in a room by the indoor heat exchanger 33, and is gasified. After then, the working gas passes through the suction pipe 13 and is sucked by the rotary type compressor 30. On the other hand, in case of operating the heating machine, as shown by a solid line arrow, the working gas is flowed back contrary to the cooling operation. The compressed working gas having the high temperature and high pressure passes through the four rectangular valve 34 from the discharge pipe 14, and flows into the indoor heat exchanger 33. Further, the working gas is blown by the fan 33*a* so that the heat is radiated, the working gas is liquefied, is throttled by the expansion valve 32 is adiabatically expanded, is changed to the low temperature and low pressure, absorbs the heat from an outside air by the outdoor heat exchanger 33, and is gasified. After then, the working gas passes through the suction pipe 13 and is sucked into the rotary type compressor 30.

Figure 23:
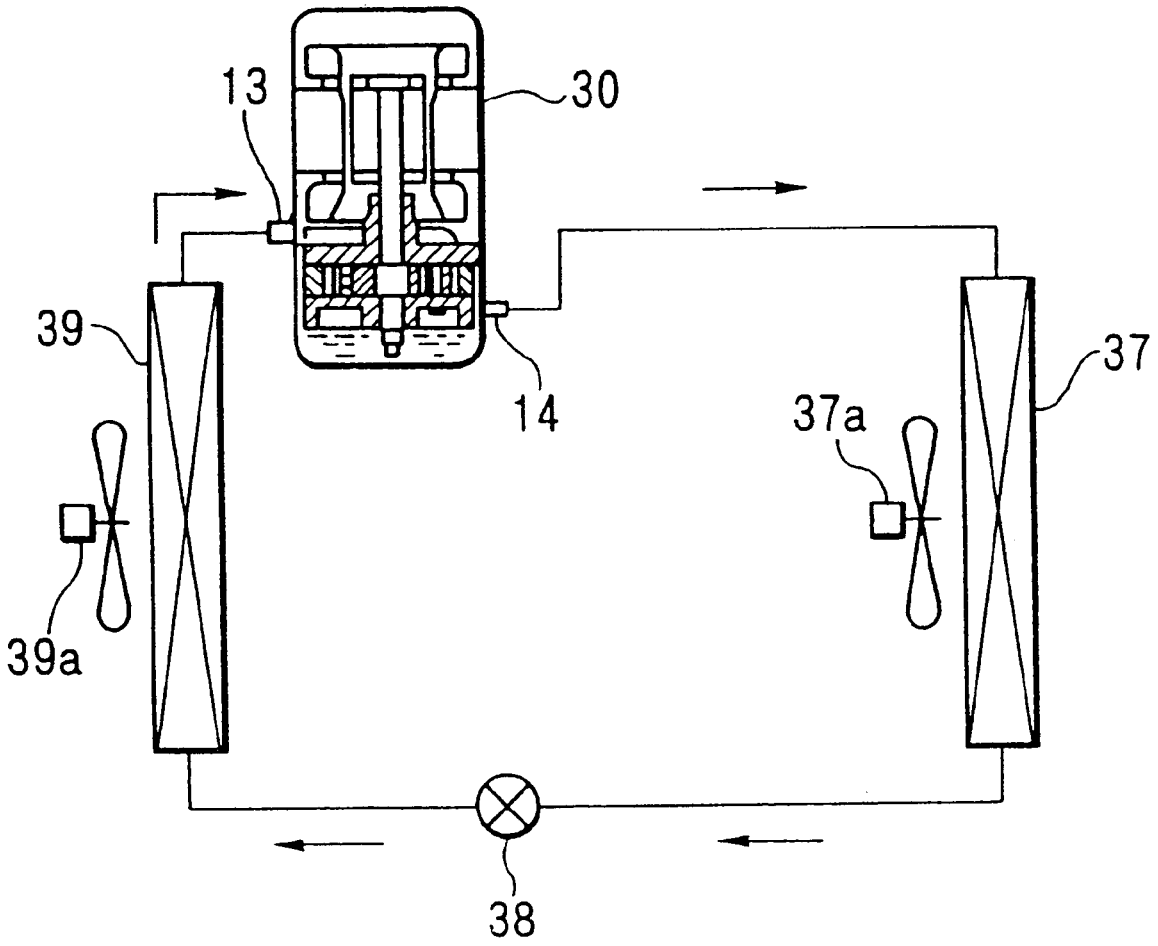
FIG. 23 is a view showing a cooling system using the rotary type compressor of the present invention.

FIG. 23 shows the cooling system mounting the rotary type compressor of the present invention. This cycle is exclusively used for the refrigeration (cooling). In FIG. 23, a numeral 37 denotes a condenser, a numeral 37*a* denotes a condenser fan, a numeral 38 denotes an expansion valve, a numeral 39 denotes an evaporator, and a numeral 39 denotes an evaporator fan.

The rotary type compressor 30 is started so that the working fluid is compressed between the cylinder 4 and the rotary piston 5. As shown by the solid line, the compressed working gas having the high temperature and high pressure flows into the condenser 37 from the discharge pipe 14. Further, the working gas is blown by the fan 37*a* so that the heat is radiated, the working gas is liquefied, is throttled by the expansion valve 38, is adiabatically expanded, is changed to the low temperature and low pressure, absorbs a heat by the evaporator 39, and is gasified. After then, the working gas passes through the suction pipe 13 and is sucked by the rotary type compressor 30. Since the rotary type compressor is mounted to this system in FIGS. 22 and 23, it is possible to enhance the energy efficiency, to reduce the vibration and noise, and to obtain more reliable cooling and air conditioner system. Where, the low pressure type is exampled and explained as the rotary type compressor 30, further, the high pressure type can be also functioned similarly so that it is possible to obtain the same effects.

Figure 24:
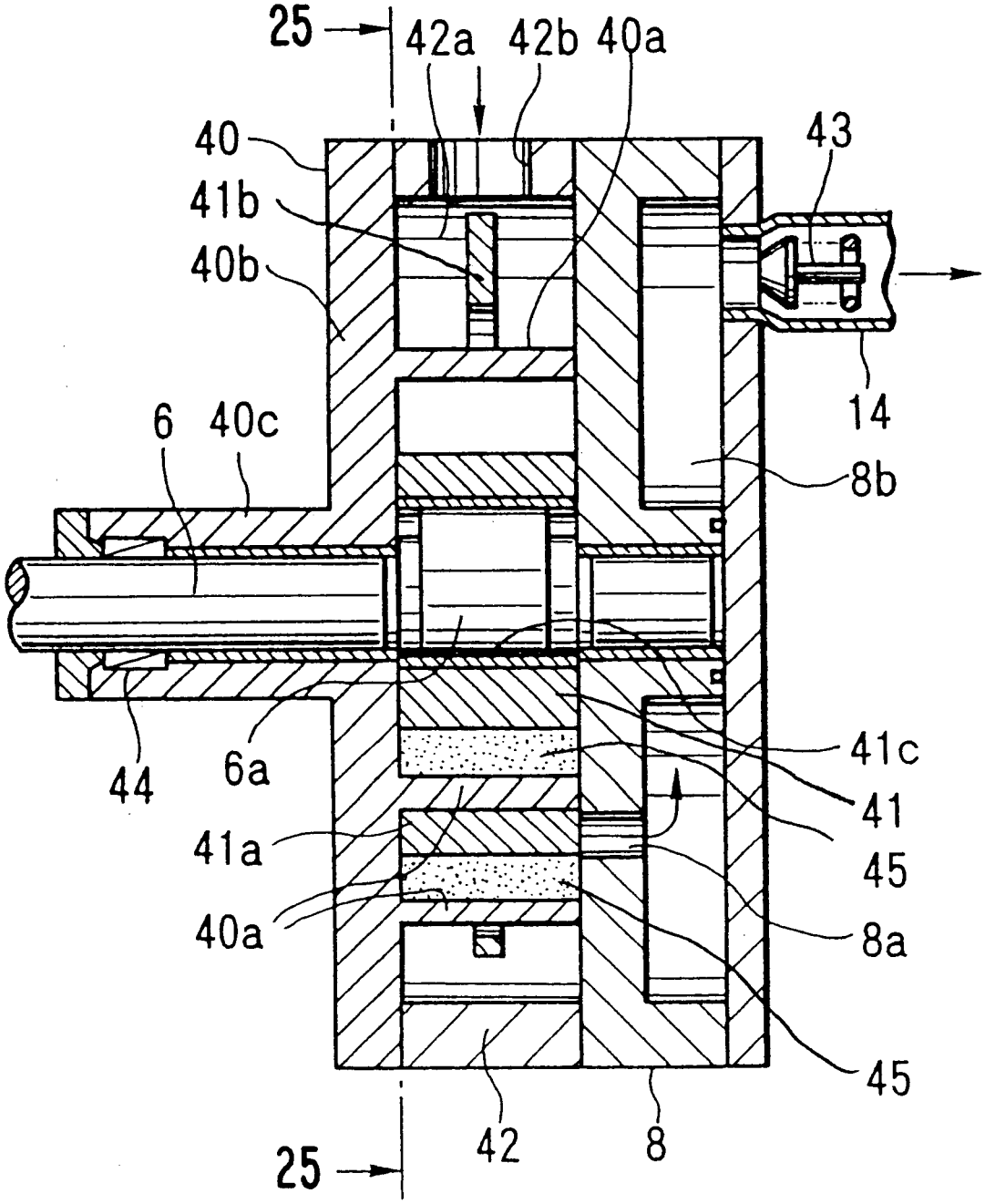
FIG. 24 is a partial vertical sectional view of the rotary type fluid machine according to another embodiment of the present invention used as a pump.
Figure 25:
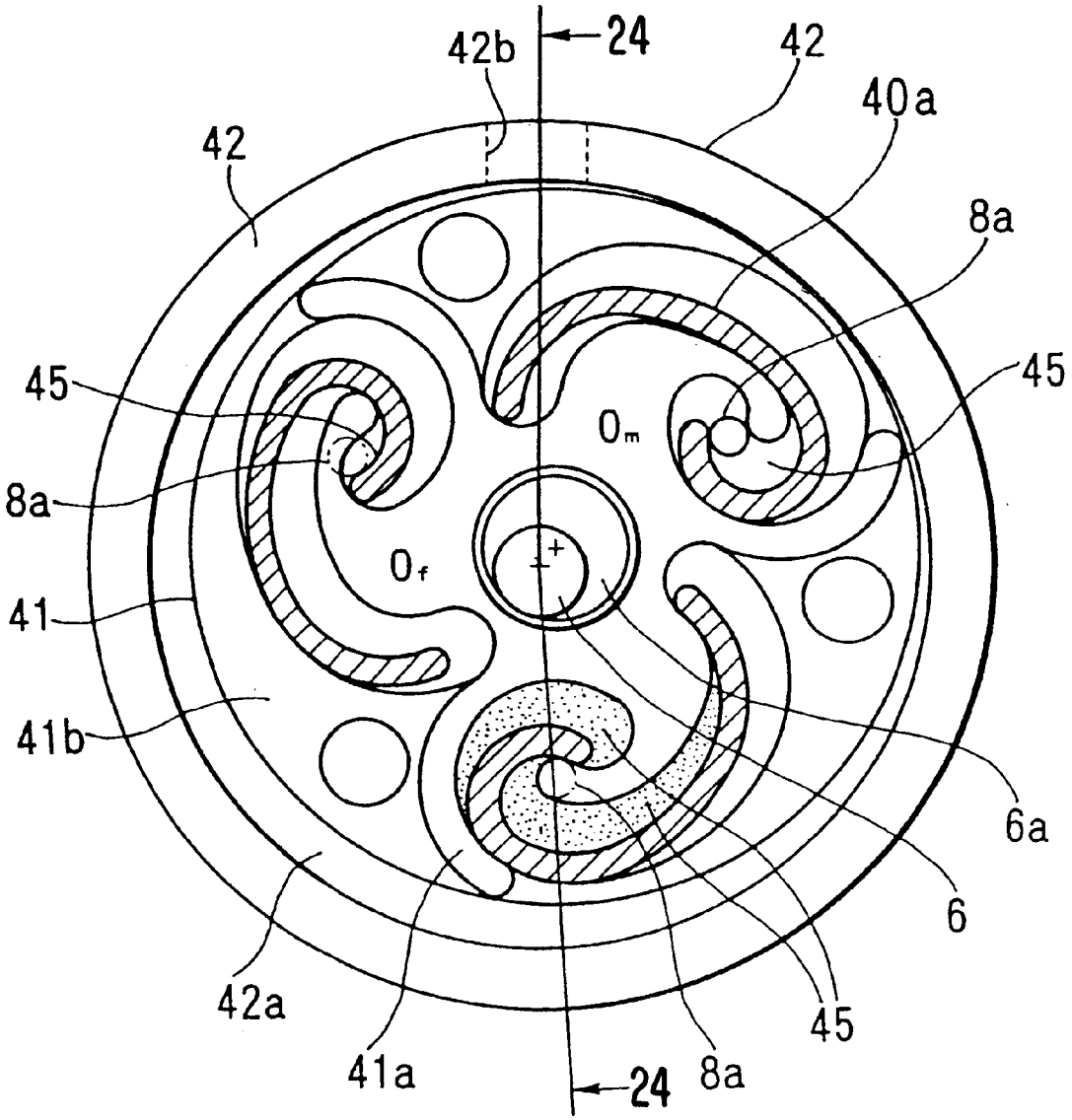
FIG. 25 is a cross-sectional view taken along line B—B of FIG. 24.

Next, another embodiment of the present invention will be explained. FIG. 24 shows a partial longitudinal sectional view of the rotary type fluid machine according to another embodiment of the present invention used as the pump (corresponding to a cross-sectional view taken on line C—C of FIG. 25). FIG. 25 shows a cross-sectional view taken on line B—B of FIG. 24. The elements having the same reference numbers in FIGS. 1–3 are the same portions and have the same action in FIGS. 24–25. In FIGS. 24–25, a numeral 40 denotes a fixed side member comprising a fixed spiral body 40*a*, an end plate portion 40*b*, and a main bearing 40*c*, each portion integrated with one another. A numeral 41 denotes a rotary side member comprising a rotary spiral body 41*a*, a reinforcement plate 41*b* for linking the rotary spiral body 41*a* with the outer peripheral portion near the center in the direction of the shaft of the spiral body, and a bearing 41*c* located at the center portion of the rotary spiral body 41*a*. A numeral 42 denotes a ring portion surrounding the outer periphery of the fixed spiral body 40*a*, wherein a suction chamber 42*a* is formed in the ring portion 42, and the ring portion 42 is linked through the outer portion by a suction port 42*b*. A numeral 43 denotes a non-return valve, and a numeral 44 denotes a shaft sealing apparatus. A numeral 45 denotes the working chamber formed by engaging the fixed spiral body 40*a* with the rotary spiral body 41*a*. A reference symbol Om denotes the center of the rotary side member 41 used as the displacer, and a reference symbol Of denotes the center of the fixed side member 40 (or the drive shaft 6). Where, in the fixed side member 40, the fixed spiral bodies 40*a* having the wrap angle of substantially 360° are arranged on the end plate portion 40*b* at three points (at least more than two points) around the center of at substantially equal pitch. The shape of the rotary spiral body 41*a* of the rotary side member 41 is determined so that the rotary spiral body 41*a* is engaged with the fixed spiral bodies 40*a*.

The flow of the working fluid (in this case, an incompressible liquid) is shown by an arrow in FIG. 24. The working fluid passes through the suction port 42*b* formed in the ring portion 42, enters into the suction chamber 42*a*. The drive shaft 6 is rotated by the motor element (not shown) in order to gyrating the rotary side member 41 so that the working fluid is sucked into the working chamber 45. The displacement of the working chamber 45 is reduced so that the working fluid is moved, is passed through the discharge port 8*a* formed on the end plate of the auxiliary bearing 8, is entered into the discharge chamber 8*b*, is passed through non-return valve 43 and the discharge pipe 14, and is transmitted outwardly. The basic principle of the work according to the embodiment is similar to the principle the rotary type compression element 1 shown in FIG. 2. The difference between FIG. 24 and FIG. 2 is that, since the working fluid is the incompressible liquid, the discharge process starts at the same time of the suction completion. Also, the characteristic of the variation of the displacement in the working chamber 45 and the variation of the gas compression torque during one rotation of the shaft are similar to those in FIGS. 7 and 8. Accordingly, it is possible to largely reduce the fluid loss (over-compression loss) of the discharge process, and to enhance the performance. Further, it is possible to obtain the effect such as the reduction of the vibration and noise, similarly to the above embodiment.

Figure 26:
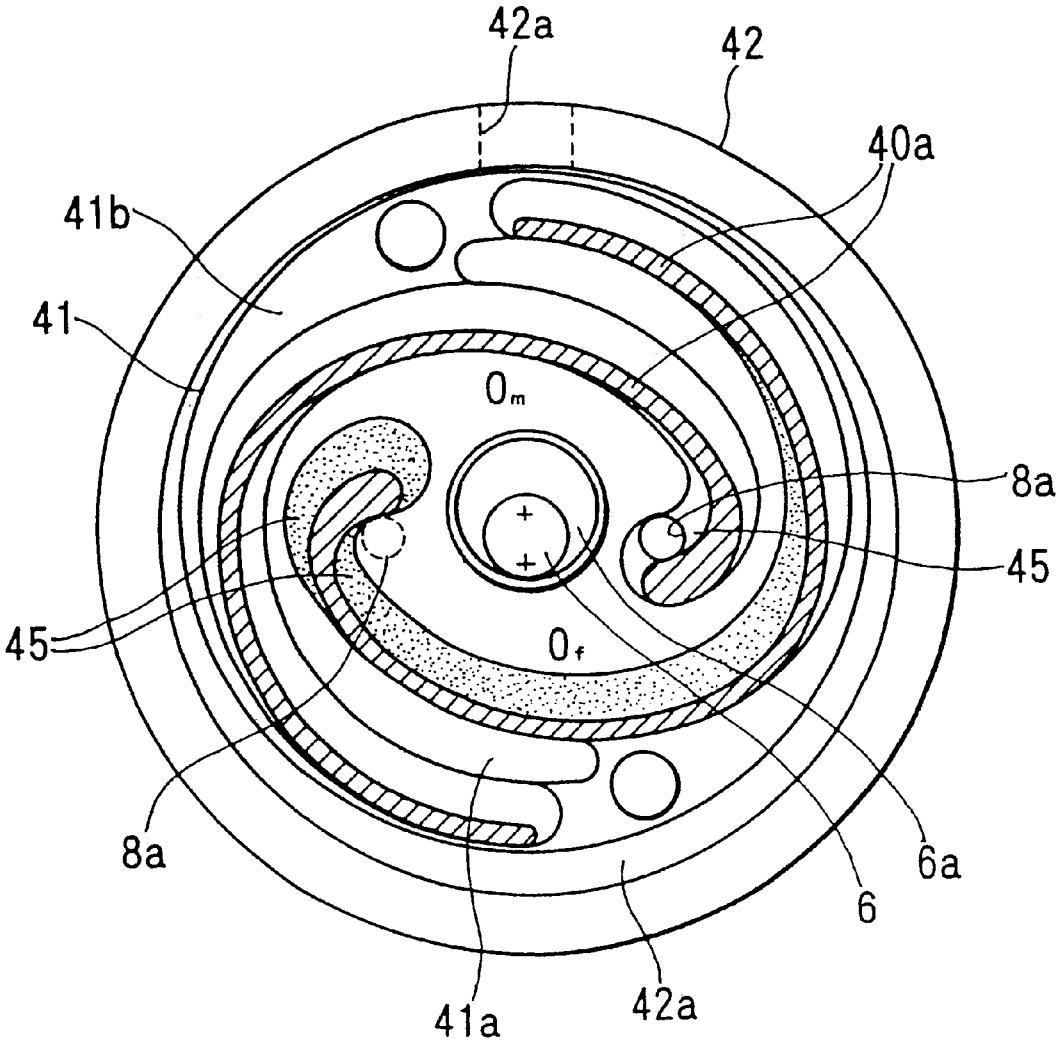
FIG. 26 is a cross-sectional view of the rotary type fluid machine according to another embodiment of the present invention in case of two working chambers.

The rotary type fluid machine provided with the three fixed spiral bodies 40*a* whose wrap angle is practically substantially 360° on the end plate portion 40*b* of the fixed side member 40 is described above. The present invention is not limited to this example. Similarly to the above embodiment, the rotary type fluid machine wherein the number of the fixed spiral bodies 40*a* may be N (many threads) more than 2 may be applied (the value of N is also practically less than 8–10, similarly to the above embodiment). FIG. 26 shows a cross-sectional view of the rotary type fluid machine according to another embodiment of the present invention in case of N=2. The elements having the same reference numbers in FIGS. 24–25 are the same portions and have the same action in FIG. 26. The basic principle of the work is similar to that of FIGS. 24 and 25.

In the rotary type fluid machine for allowing the variation the torque to some extent, as the embodiment, it is possible to reduce the number of the fixed spiral bodies 40*a*, and to simplify the construction, thereby to reduce the cost.

According to the above embodiment, the compressor and the pump are exampled as the rotary type fluid machine. Aside from these example, the present invention can be also applied to the expander and the motor machine. Also, according to the embodiment of the operation of the present invention, one side (the cylinder side) is fixed and the other side (the rotary piston) is not rotated, but gyrated around substantially constant gyrating radius. However, the present invention may be applied to the rotary type fluid machine for rotating both of sides according to the operation relatively equivalent to the above operation.

POSSIBILITY OF INDUSTRIAL UTILIZATION

As described above, according to the present invention, the displacement type fluid machine comprises a plurality of working chambers arranged at more than two portions around the drive shaft, wherein the shaft angle from the suction completion to the discharge completion in each working chamber is substantially 360°. Thereby, it is possible to largely reduce the over-compression loss of the discharge process. Further, the rotating moment acted on the rotary piston is reduced so that the friction loss between the rotary piston and the cylinder is reduced. Thereby, it is possible to enhance the performance and to obtain more reliable displacement type fluid machine. Also, this rotary type fluid machine is mounted to the refrigeration system so that it is possible to obtain the cooling and air conditioner system having the high energy efficiency and reliability.

What is claimed is:

1. A displacement type fluid machine comprising at least one suction port, at least one discharge port, a displacer having an outer wall surface whose section shape comprises a continuous curve, a rotating shaft around of a center of rotation of which said displacer orbits, and a cylinder having an inner wall surface within which said displacer is provided and having a plurality of extrusions extruded inwardly of said cylinder, wherein the inner wall surface of said cylinder and the outer wall surface of said displacer are shaped such that one space would be provided between the inner wall surface of said cylinder and the outer wall surface of said displacer if a center of said displacer is located on the center of rotation of said rotating shaft, and a plurality of spaces are formed between the inner wall surface of the cylinder and the outer wall surface of the displacer when said displacer is set to an orbiting position;

wherein a rotational moment acting on said displacer is borne by contact of the inner wall surface of said cylinder and the outer wall surface of said displacer, and said displacer is provided with at least one through hole for working the outer wall surface of said displacer during manufacture of said displacer, said at least one through hole extending in an axial direction of said rotating shaft.

* * * * *